US012092443B1

(12) United States Patent
Anderson et al.

(10) Patent No.: US 12,092,443 B1
(45) Date of Patent: Sep. 17, 2024

(54) BROADHEAD

(71) Applicants: Trevor James Anderson, Franklin, TN (US); Jacob Edward Anderson, Franklin, TN (US)

(72) Inventors: Trevor James Anderson, Franklin, TN (US); Jacob Edward Anderson, Franklin, TN (US)

(73) Assignee: Toulou Broadhead Company, LLC, Franklin, TN (US)

( * ) Notice: Subject to any disclaimer, the term of this patent is extended or adjusted under 35 U.S.C. 154(b) by 0 days.

(21) Appl. No.: 18/094,092

(22) Filed: Jan. 6, 2023

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 5,257,809 | A | 11/1993 | Carrizosa | |
| 5,482,294 | A | 1/1996 | Sullivan et al. | |
| 6,663,518 | B1 | 12/2003 | Kuhn | |
| 6,887,172 | B2 | 5/2005 | Arasmith | |
| 6,918,848 | B2 | 7/2005 | Kuhn | |
| 6,966,856 | B1 | 11/2005 | Hajek | |
| 6,997,827 | B1 | 2/2006 | Grace, Jr. et al. | |
| 7,037,223 | B2 | 5/2006 | Kuhn | |
| 7,182,706 | B2 | 2/2007 | Barrie | |
| 7,597,637 | B2 | 10/2009 | Sohm | |
| 7,771,297 | B2 * | 8/2010 | Kuhn | F42B 6/08 473/583 |
| 7,935,012 | B2 * | 5/2011 | Lee | F42B 6/08 473/578 |
| 8,313,398 | B2 * | 11/2012 | Baker | F42B 6/08 473/583 |
| D695,872 | S | 12/2013 | Lennon | |
| 8,771,113 | B2 * | 7/2014 | Patton | F42B 6/08 473/583 |
| 9,062,944 | B1 | 6/2015 | Dupuis | |
| 10,054,407 | B2 * | 8/2018 | Moore | F42B 6/08 |
| 10,866,074 | B1 * | 12/2020 | Morton | F42B 6/08 |
| 2021/0270584 | A1 * | 9/2021 | Jonsson | F42B 6/08 |
| 2023/0251069 | A1 * | 8/2023 | Fisher | F42B 6/08 473/583 |
| 2023/0258439 | A1 * | 8/2023 | Brodie | F42B 6/08 473/583 |

OTHER PUBLICATIONS

Ozcut Broadheads website at https://www.ozcutbroadheads.com/, accessed and screenshots taken on Nov. 22, 2022.

* cited by examiner

*Primary Examiner* — John A Ricci
(74) *Attorney, Agent, or Firm* — Master Key IP, LLP; Jeromye V. Sartain

(57) ABSTRACT

A broadhead generally comprises a body having a plurality of blades defining a proximal end and an opposite distal tip. Each blade has a first side having a first major surface and an opposite second side having a second major surface terminating laterally in a straight lateral edge that terminates distally at a distal point proximal of the distal tip and terminates proximally at a proximal point. For each blade a distal transverse axis is at an angle to a proximal transverse axis such that the first major surface of each blade is sloped distally and the first major surfaces and the lateral edges of the plurality of blades are diverging, whereby the distal tip is twisted relative to the proximal end.

20 Claims, 22 Drawing Sheets

BROADHEAD

BACKGROUND

The subject of this patent application relates generally to arrows and arrowheads, and more particularly to a broadhead configured for improved rotation and penetration.

The following description includes information that may be useful in understanding the present invention. It is not an admission that any of the information provided herein is prior art or relevant to the presently claimed invention, or that any publication specifically or implicitly referenced is prior art.

Applicants hereby incorporate herein by reference any and all patents and published patent applications cited or referred to in this application, to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

By way of background, arrows and arrowheads as used in the sport of archery and in bow hunting and the like date back not just centuries but millennia and have taken numerous forms to suit particular purposes, from recreation to game hunting to combat. And yet like the wheel and other utilitarian designs implemented by various civilizations, improvements to arrows and arrowheads are continually being made in the interest of achieving better performance, reduced cost or complexity, greater longevity, etc.

A broadhead is a particular type of relatively large arrowhead for attachment to an arrow shaft for use in hunting, usually having two to four blades that are either solid or have openings, known as being "vented." The blades of a broadhead may be fixed, removable, or pivotable or expandable. In general, various broadhead designs have been proposed over the years for the purpose of improved or particular performance, often relating to inducing rotation of the arrow or arrowhead for aerodynamic effects resulting in increased accuracy and reduced drag in flight as well as increased penetration of the target. Related secondary considerations have to do with the arrow flying more quietly so as to be undetected by prey, and thus the geometry of the broadhead and its leading and trailing edges, including in and around any vents.

One early example of a particular broadhead design aimed at such objectives of improved flight and target penetration is shown in U.S. Pat. No. 5,257,809 to Carrizosa entitled "detachable rotary broadhead apparatus having drill bit-like characteristics" and directed to a broadhead arrow having mechanical structure that improves the rotational freedom of the broadhead portion to prolong rotation during penetration of a target. The mechanical structure further includes an arrow tip, formed as a fluted arrow tip structure, that initiates target penetration by producing drill bit-like action upon rotationally contacting a target. The fluted arrow tip is followed by the bladed, rotatably free, broadhead portion having a plurality of elongated blades that are formed having a sharp, edged, concave upper body structure, contoured for cutting and discarding, in a plow-like manner, any target material, such as flesh and bone material encountered during rotary penetration of a target.

U.S. Pat. No. 6,887,172 to Arasmith is entitled "arrow broadhead" and directed to an improved broadhead arrowhead including spiral-shaped, curving or twisting blades of increasing width along a leading edge thereof, and an insert including a bearing element which allows for broadhead rotation independent of the arrow shaft about the longitudinal axis of the arrow shaft during flight. The curved blades and bearing element of the present invention allow the broadhead to continue rotating after contacting the target.

U.S. Pat. No. 6,997,827 to Grace, Jr. et al. is entitled "aerodynamic improvements to archery broadheads" and directed to a specific broadhead configuration for reducing the turbulence generated by a broadhead in flight, thereby reducing the resulting wind noise and aerodynamic drag generated in flight. The aerodynamic improvements to the archery broadhead are accomplished by providing edge treatments on at least one of the leading edges, trailing edges, oblique edges, or longitudinal edges of the broadhead blades. Specific edge treatments may include a linear tapered profile, a non-linear tapered profile, or a radiused or rounded profile. Furthermore, certain edge treatments may be asymmetric so as to impart a rotational moment or spin to the arrow during flight. Such edge treatments are suitable for use on vented and non-vented blades.

U.S. Pat. Nos. 7,037,223 and 7,771,297 to Kuhn are entitled "broadhead arrowhead" and are directed to a broadhead arrowhead including a ferrule and one end portion which is tapered to a substantial point. One or more blade assemblies extend outwardly from the ferrule. Each blade assembly has a first substantially planar main surface portion disposed in a plane at least substantially parallel to a longitudinal axis of the ferrule, a second surface portion having a planar region offset at an angle to the plane of the main surface portion, and a generally continuously curved region disposed between and connecting the first and second substantially planar portions, such that the blade assembly has an airfoil-type shape.

U.S. Pat. No. 8,313,398 to Baker is entitled "helical broadhead" and directed to such a broadhead for an archery arrow including a tapered ferrule having a tip end and an arrow end and at least two helical blades which extend from the tip end to and towards the arrow end. The at least two helical blades may continuously helically curve from the tip end to the back side of the helical blades, and the helical blades may include a cutting edge. The broadhead may include a threaded shaft, and the helical blades may be a constant thickness or have a tapered cross-section, and the cutting edges may form a tip.

U.S. Pat. No. 8,771,113 to Patton is entitled "Broadhead for improved rotation and bone-piercing capability" and is directed to a broadhead for increased target penetrability in use with an arrow shaft. The broadhead includes a receiver that is configured to receive the arrow shaft, the receiver including a central axis. The broadhead also includes a pair of oppositely-directed blades offset from the receiver central axis, the blades including a tapered geometry.

U.S. Pat. No. 9,062,944 to Dupuis is entitled "broadhead arrowhead" and directed to such a broadhead arrowhead having a cylindrical central body having a longitudinal axis and a plurality of wing blades that extend radially from the central body. Each wing blade includes a generally triangular surface including a leading edge, a trailing edge, and a root edge along the central body. A foil portion is formed in each wing blade and defined by a line extending from a forward point where the wing blade meets the central body at the root edge to the trailing edge. The leading edge is sharpened and each wing blade is oriented in the same circumferential direction with respect to the central body.

U.S. Pat. No. 10,054,407 to Moore et al. is entitled "broadhead for bow hunting arrow" and directed to an improved broadhead for an archery arrow including a blade member having a rear portion, a tip opposite the rear portion with a chisel point, and a pair of opposing blades. The tip can be generally flat. Each of the opposing blades includes a cutting edge disposed between the blade member rear portion. Each cutting edge includes a concave curved portion and can include a beveled portion. Each of the opposing blades has a surface that includes a radial curve and each of the cutting edges has a generally helical shape. The blade member can be formed from a single sheet of metal and can be fixed to a ferrule for mounting to an arrow.

U.S. Pat. No. 10,866,074 to Morton is entitled "broadhead" and directed to a broadhead for an arrow comprising a plurality of blade portions that extend about a body portion. The blade portions are offset relative to each other, and each blade portion extends outwardly from the body portion. The blade portion is shaped with a relatively narrow front tip and expands to a relatively broader rear section. Each blade portion has a beveled outer cutting edge that angles downwardly from a first side to a second side. The arrangement and orientation of the blade portions assists with the rotation of the arrow during flight thereby providing increased accuracy and reduced drag.

While prior broadhead designs such as described above are again aimed at the same purpose of improved flight and target penetration, each such prior design is lacking in one or more respects, such as being somewhat complex in structure and assembly and thus relatively expensive, relatively weak due to the shape or assembly of the blades, and/or ultimately inferior in flight and penetration characteristics. Accordingly, what has been needed and heretofore unavailable is an improved broadhead design that is highly effective in use and relatively simple in construction that thus achieves better performance, reduced cost and complexity, and greater longevity over prior broadheads. Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing a broadhead configured for improved rotation and penetration. In at least one embodiment, the broadhead comprises a body having a plurality of blades defining a proximal end and an opposite distal tip, the body having a longitudinal axis therethrough, wherein each blade has a first side having a first major surface and an opposite second side having a second major surface terminating laterally in a straight lateral edge, wherein the lateral edge terminates distally at a distal point proximal of the distal tip and terminates proximally at a proximal point, a distal transverse axis of each blade being a straight line perpendicular to the longitudinal axis through each distal point, and a proximal transverse axis of each blade being a straight line perpendicular to the longitudinal axis through each proximal point, the distal and proximal transverse axes passing entirely through each respective blade, and wherein for each blade the distal transverse axis is at an angle to the proximal transverse axis such that the first major surface of each blade is sloped distally and the first major surfaces and the lateral edges of the plurality of blades are diverging, whereby the distal tip is twisted relative to the proximal end.

Other objects, features, and advantages of aspects of the present invention will become more apparent from the following detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Figure 1:
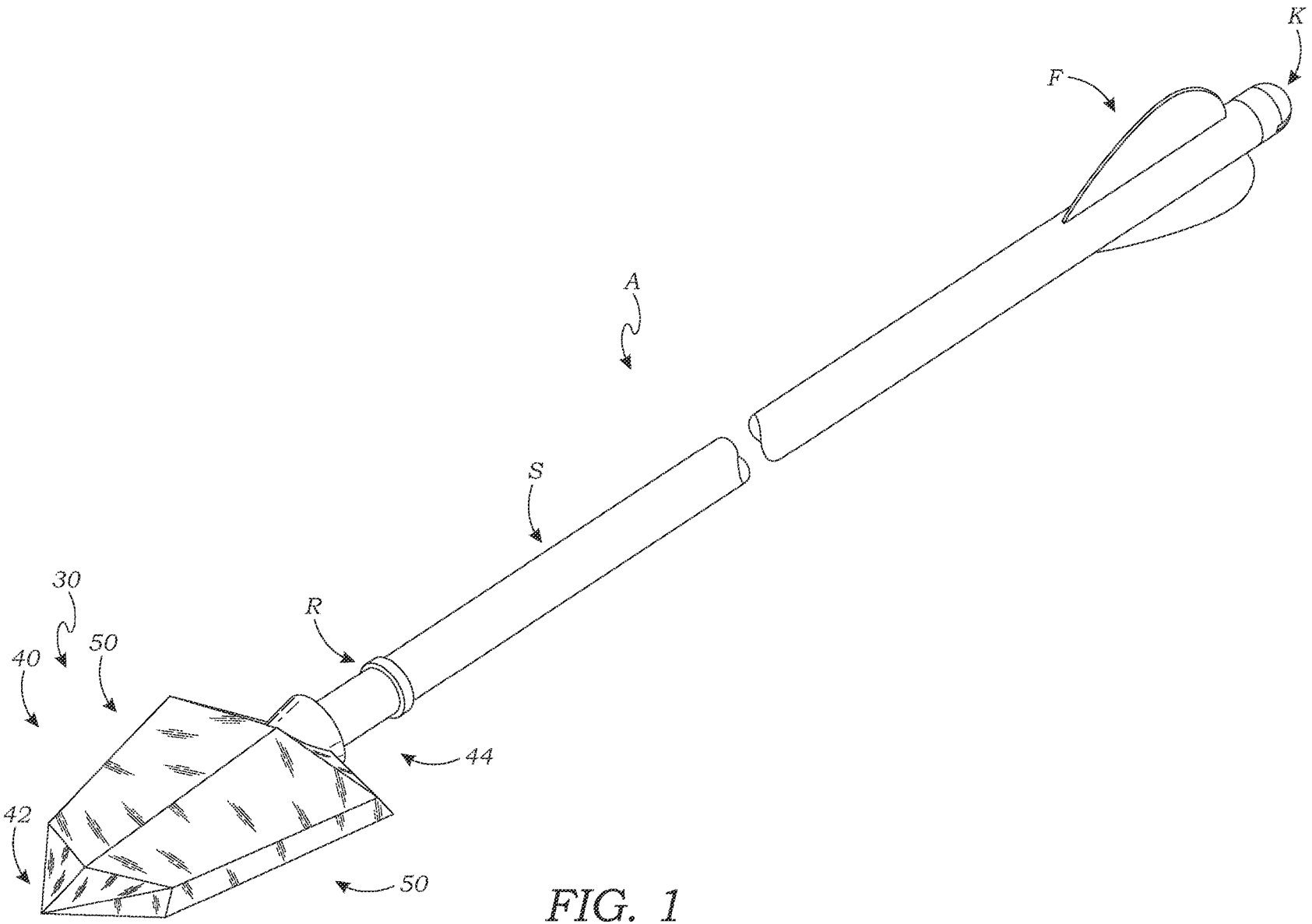
FIG. 1 is a front perspective view of an exemplary broadhead, in accordance with at least one embodiment, as installed on an arrow.
Figure 2:
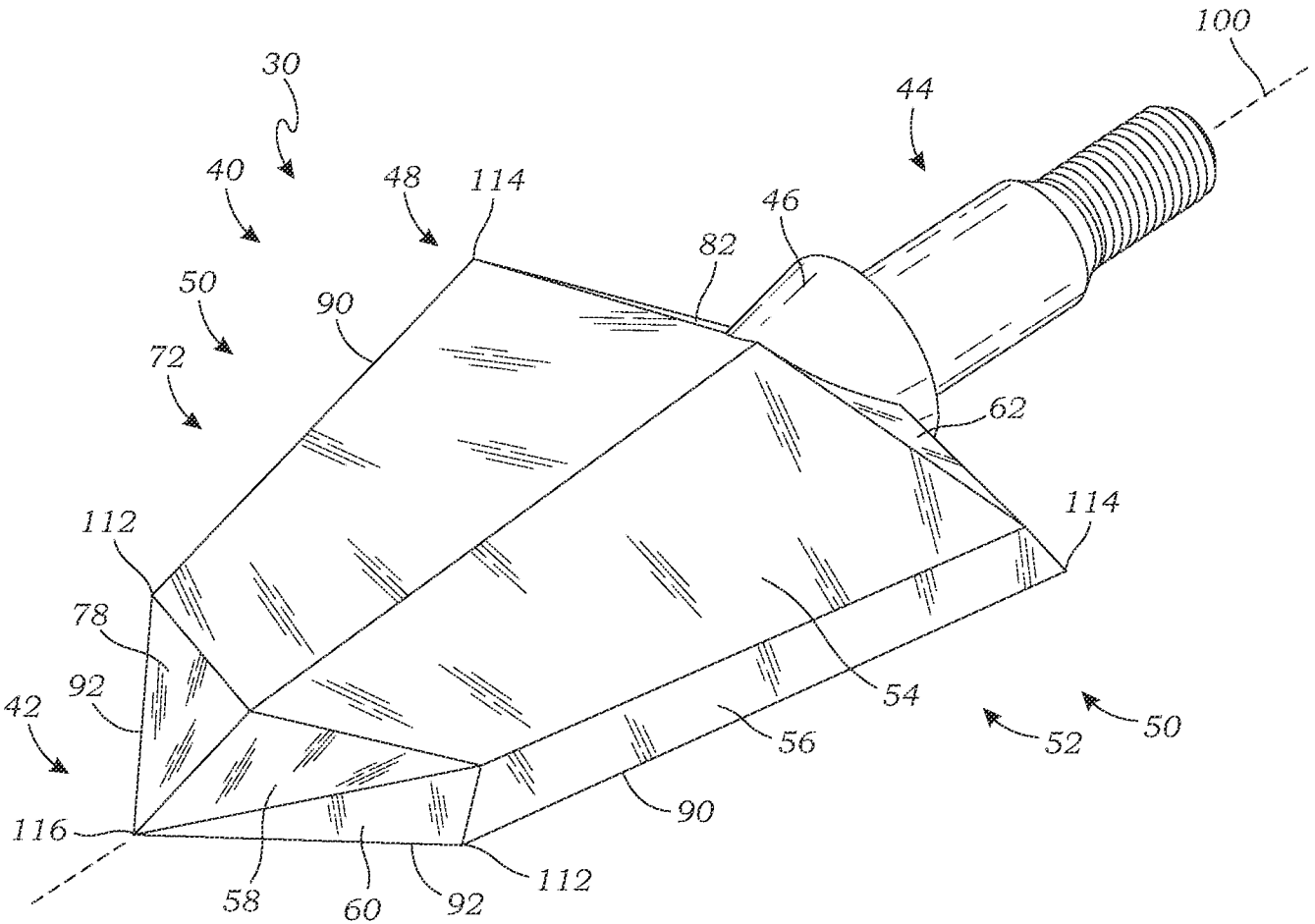
FIG. 2 is an enlarged front perspective view thereof, in accordance with at least one embodiment.
Figure 3:
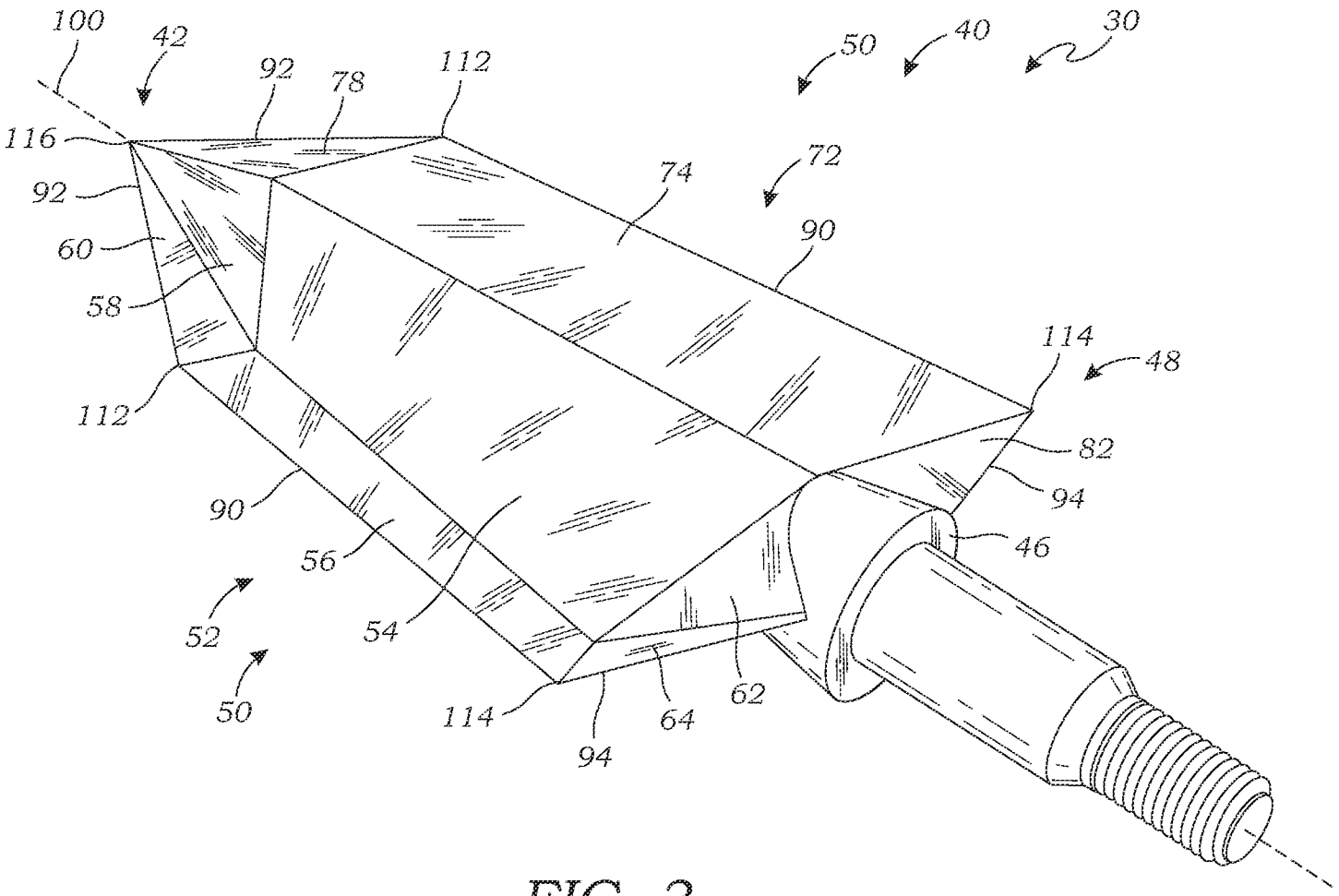
FIG. 3 is a rear perspective view thereof, in accordance with at least one embodiment.
Figure 4:
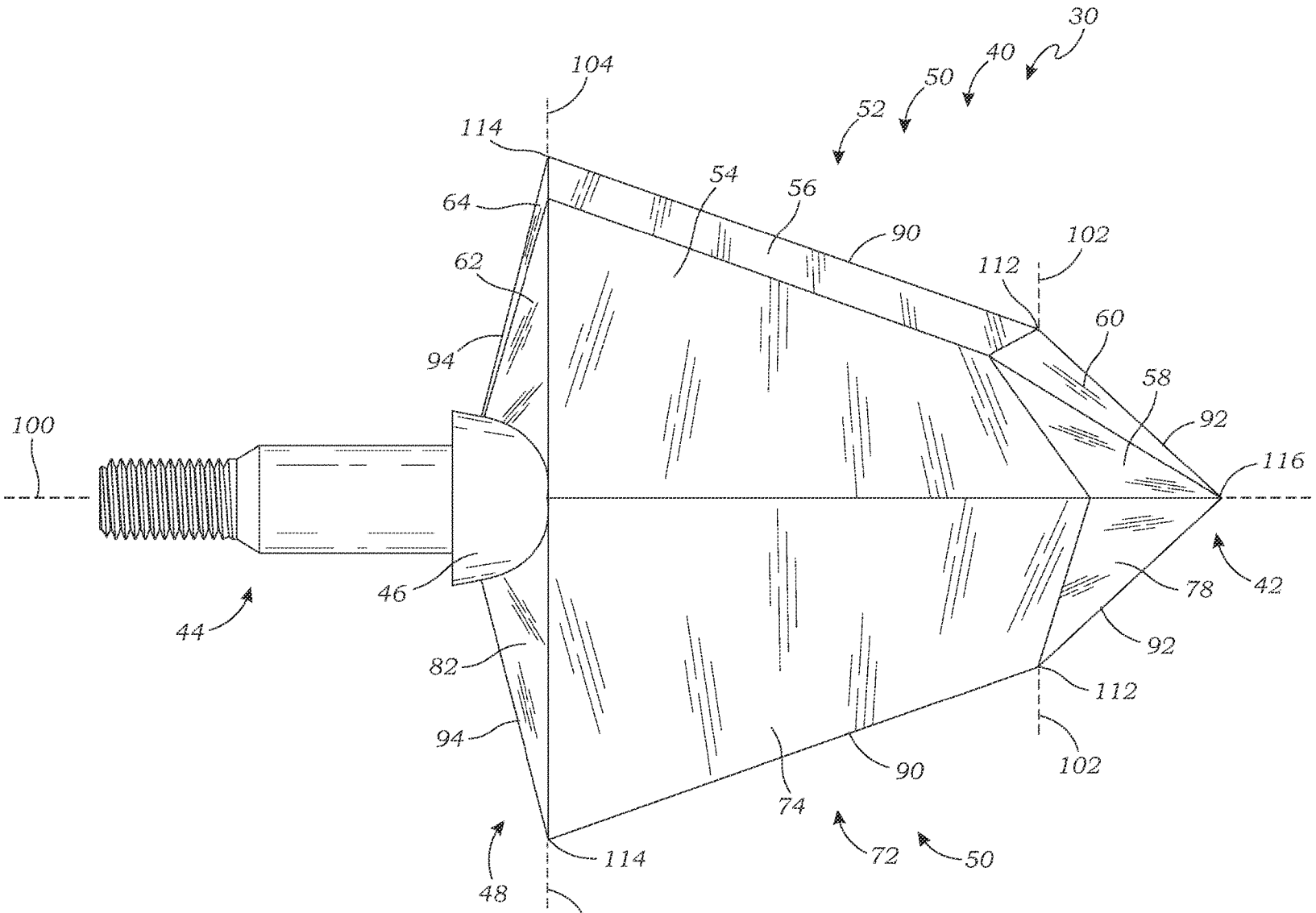
FIG. 4 is a top view thereof, in accordance with at least one embodiment.
Figure 5:
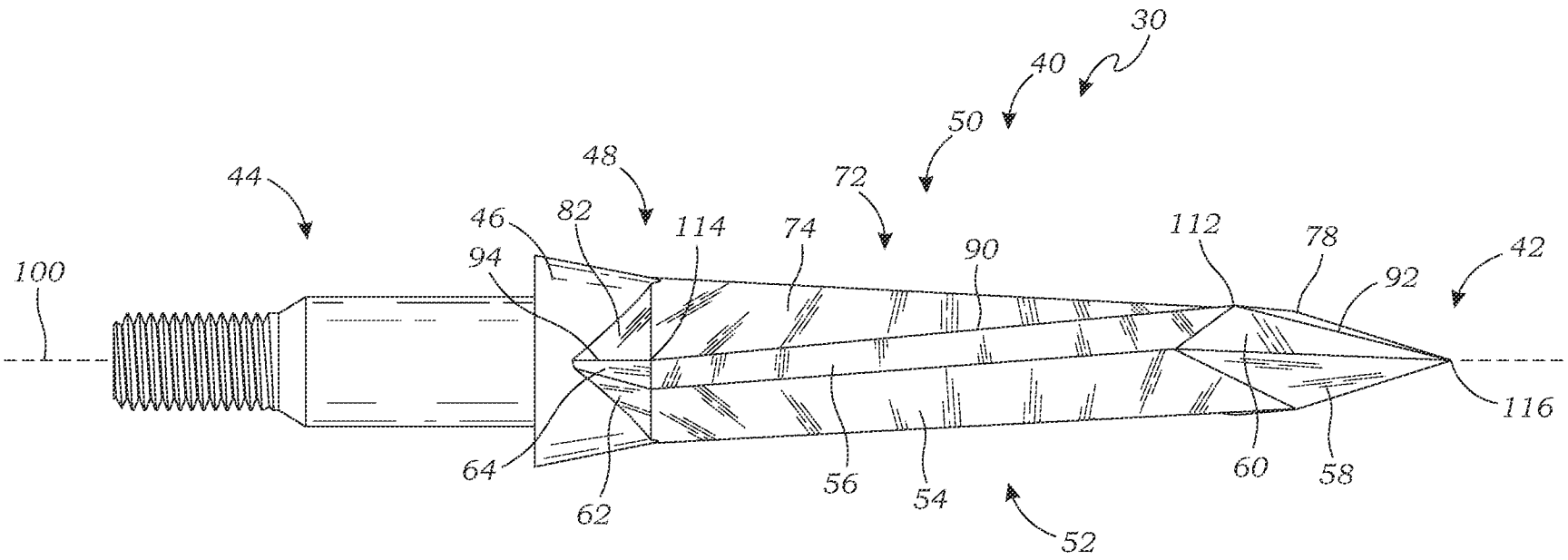
FIG. 5 is a side view thereof, in accordance with at least one embodiment.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments. More generally, those skilled in the art will appreciate that the drawings are schematic in nature and are not to be taken literally or to scale in terms of material configurations, sizes, thicknesses, and other attributes of a broadhead according to aspects of the present invention and its components or features unless specifically set forth herein.

DETAILED DESCRIPTION

The following discussion provides many exemplary embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

While the inventive subject matter is susceptible of various modifications and alternative embodiments, certain illustrated embodiments thereof are shown in the drawings and will be described below in detail. It should be understood, however, that there is no intention to limit the invention to any specific form disclosed, but on the contrary, the inventive subject matter is to cover all modifications, alternative embodiments, and equivalents falling within the scope of the claims.

Turning to FIG. 1, there is shown a front perspective view of an exemplary embodiment of a broadhead 30 according to aspects of the present invention installed on an arrow A as in use. Simply for context, the arrow A comprises a shaft S having a distal receiver R for the broadhead 30 and proximal fletching F and a knock K for receipt of a bow string (not shown) in a manner known in the art for knocking and shooting the arrow A, such arrow A thus being understood as merely illustrative. The broadhead 30 comprises, in the exemplary embodiment, a body 40 having a distal tip 42 and an opposite proximal shank 44 and a plurality of blades 50. While the exemplary broadhead 30 is shown having two opposed blades 50, it will be appreciated by those skilled in the art that other numbers and arrangements of blades 50, including but not limited to three or four, may instead be employed without departing from the spirit and scope of the invention. More generally, those skilled in the art will appreciate that all such exemplary embodiments of a broadhead 30 according to aspects of the present invention are merely illustrative in terms of the absolute and relative or proportional sizing of the broadhead 30 and its particular features, such that all such versions of the broadhead 30 as shown and described herein are to be understood as exemplary and non-limiting.

Referring to FIGS. 2-7, there are shown various enlarged perspective and orthographic views of the exemplary broadhead 30 of FIG. 1. Once more, the broadhead 30 generally comprises a body 40 having a distal tip 42 and an opposite proximal shank 44 and two opposed blades 50. The body 40 has a lengthwise longitudinal axis 100 passing centrally through the distal tip 42 and the proximal shank 44. A ferrule 46 may be provided at the transition between the shank 44 and the blades 50, or generally at the proximal end 48 of the portion of the body 40 comprising the blades 50, for added strength. Each blade 50 has a first side 52 having a first major surface 54, a first tip surface 58 distal of and at an angle to the first major surface 54, and a first trailing surface 62 proximal of and at an angle to the first major surface 54. Likewise, each blade 50 has an opposite second side 72 having a second major surface 74, a second tip surface 78 distal of and at an angle to the second major surface 74, and a second trailing surface 82 proximal of and at an angle to the second major surface 74. The second major surface terminates laterally in a straight cutting edge or lateral edge 90 effectively at the intersection of the first and second major surfaces 54, 74 and the second tip surface 78 similarly terminates in a straight leading edge 92 of the broadhead 30 that intersects and is at an angle to the lateral edge 90. As will be appreciated, each individual blade 50 is thus configured having oppositely-facing sides 52, 72 and the blades 50 are arranged in the broadhead 30 with the first side 52 of one blade 50 proximate to the second side 72 of the next blade 50, and so on, such that looking at the exemplary two-bladed broadhead 30 from the top, as in FIGS. 2-4, there is seen the first side 52 of one blade 50 and the second side 72 of the other blade 50 and looking at the broadhead 30 from the side, as in FIG. 5, there are seen the first and second sides 52, 72 of the same blade 50, the first side 52 facing down and the second side 72 facing up as the exemplary broadhead 30 is viewed from the left. Further regarding the exemplary embodiment of the broadhead 30, each first major surface 54 is formed outwardly or laterally with a first major surface bevel 56, each first tip surface 58 is formed outwardly or distally with a first tip surface bevel 60, and each first trailing surface 62 is formed outwardly or proximally with a first trailing surface bevel 64, though it will be appreciated by those skilled in the art as to any such broadhead 30 according to aspects of the present invention that any arrangement, number, and configuration of such bevels 56, 60, 64, if any, is possible, such that those shown are to be understood as exemplary and for illustration and not limitation. Where any such edge bevels 56, 60, 64 are employed it will be appreciated that for each blade 50 of the broadhead 30 the first major surface bevel 56 meets the second major surface 74 along the lateral edge 90, the first tip surface bevel 60 meets the second tip surface 78 along the leading edge 92, and the first trailing surface bevel 64 meets the second trailing surface 82 along the trailing edge 94.

Figure 6:
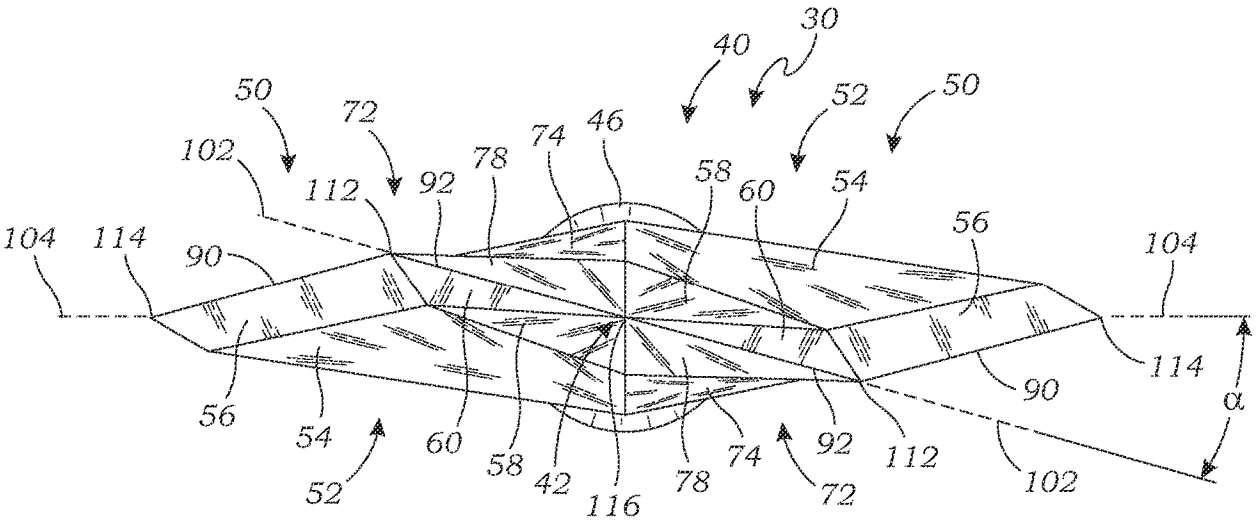
FIG. 6 is a front view thereof, in accordance with at least one embodiment.
Figure 7:
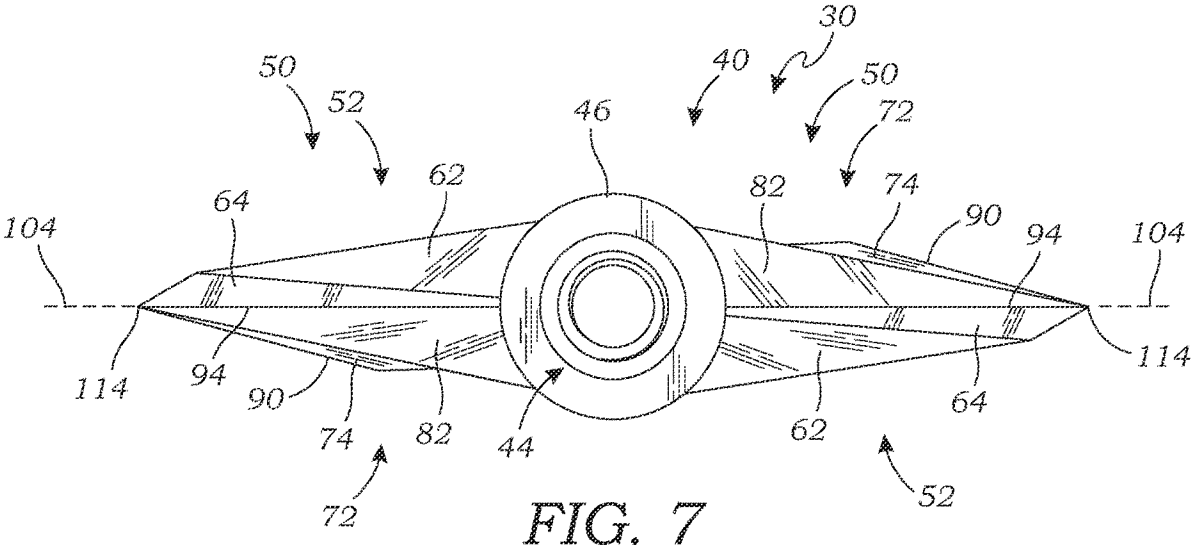
FIG. 7 is a rear view thereof, in accordance with at least one embodiment.
Figure 8:
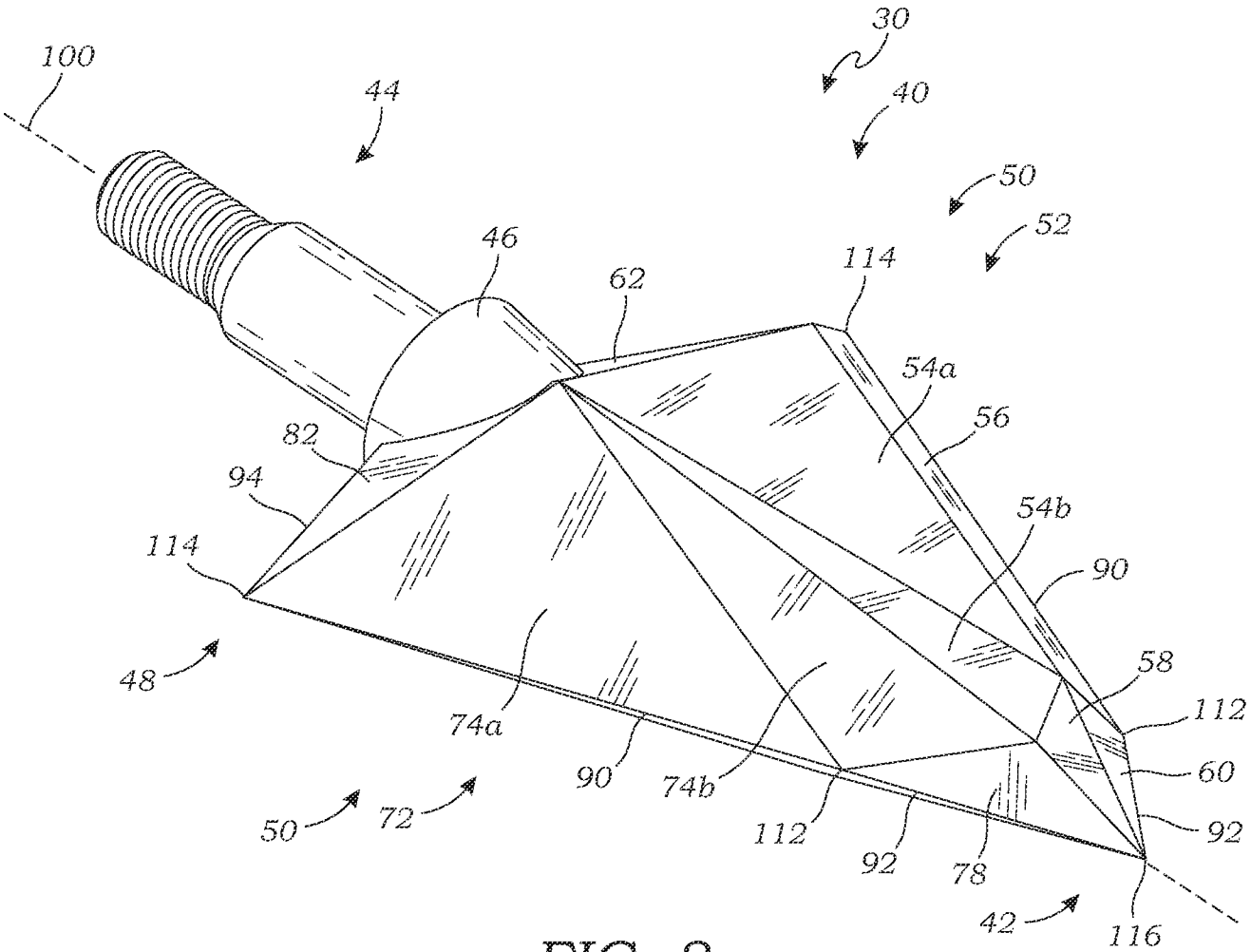
FIG. 8 is a front perspective view of an alternative exemplary broadhead, in accordance with at least one embodiment.
Figure 9:
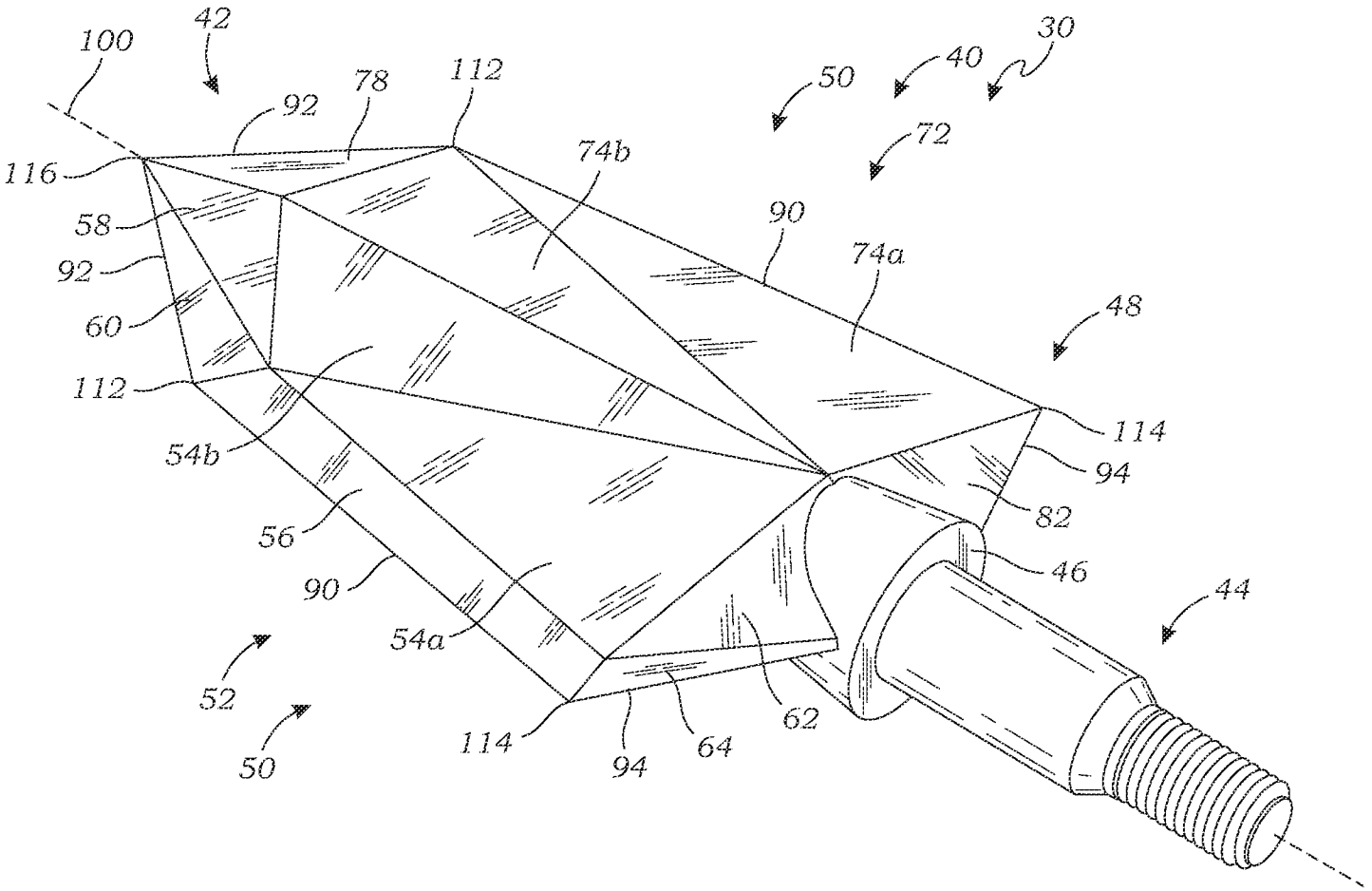
FIG. 9 is a rear perspective view thereof, in accordance with at least one embodiment.
Figure 10:
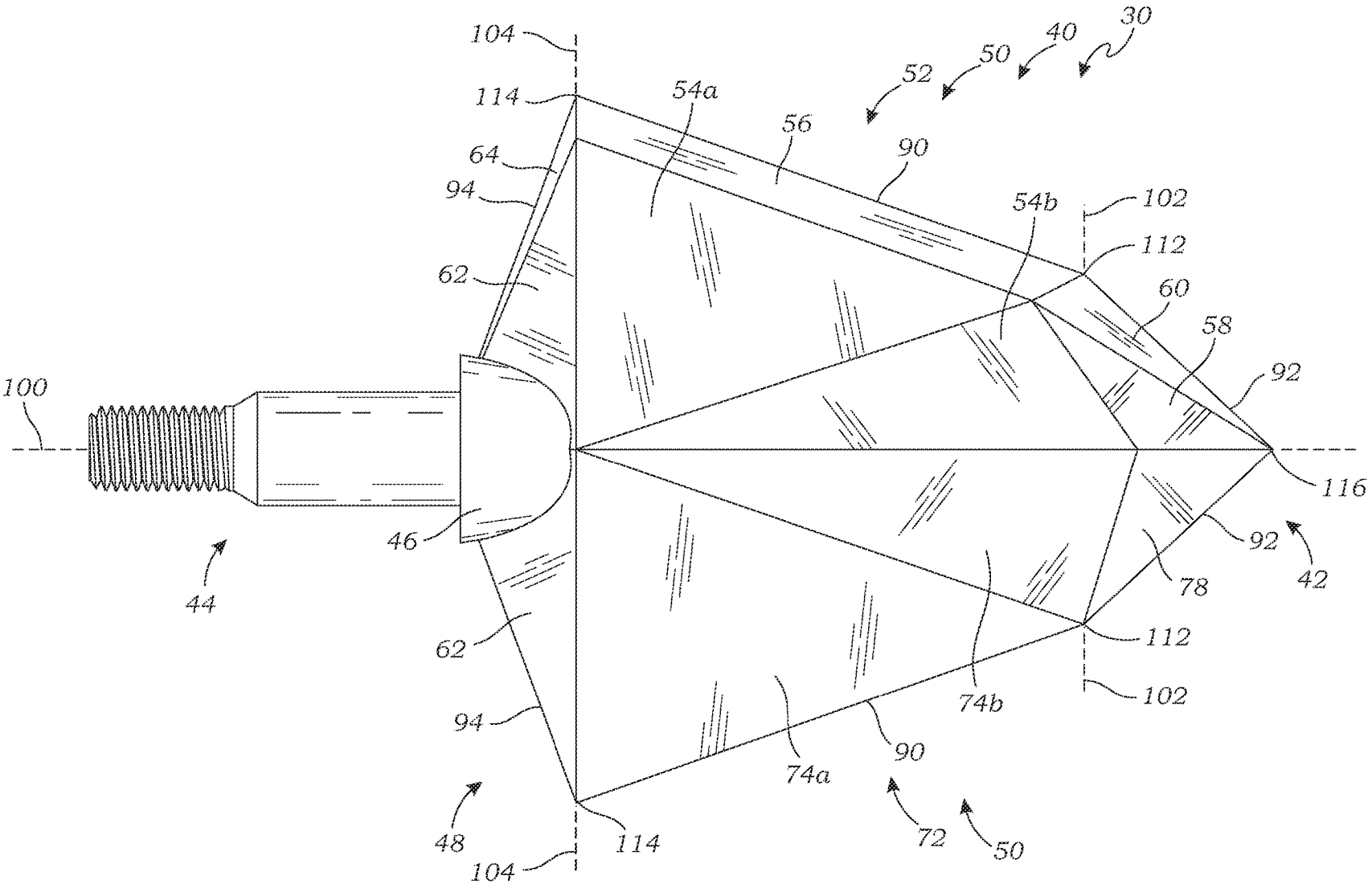
FIG. 10 is a top view thereof, in accordance with at least one embodiment.
Figure 11:
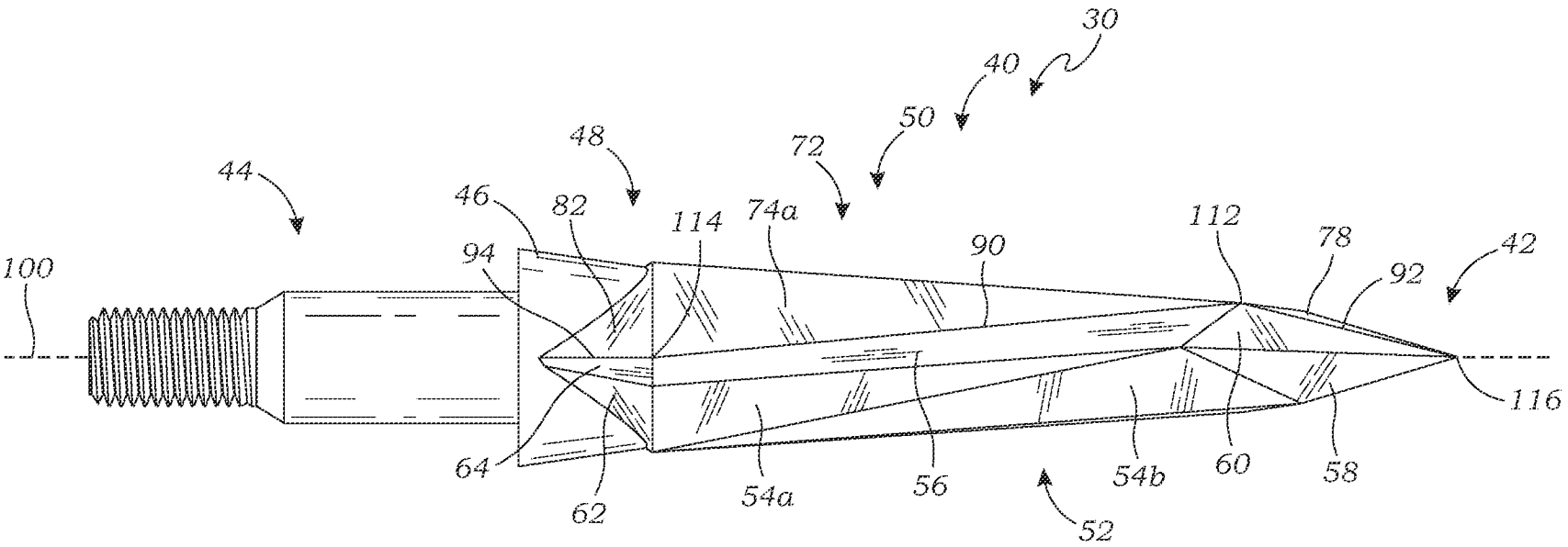
FIG. 11 is a side view thereof, in accordance with at least one embodiment.
Figure 12:
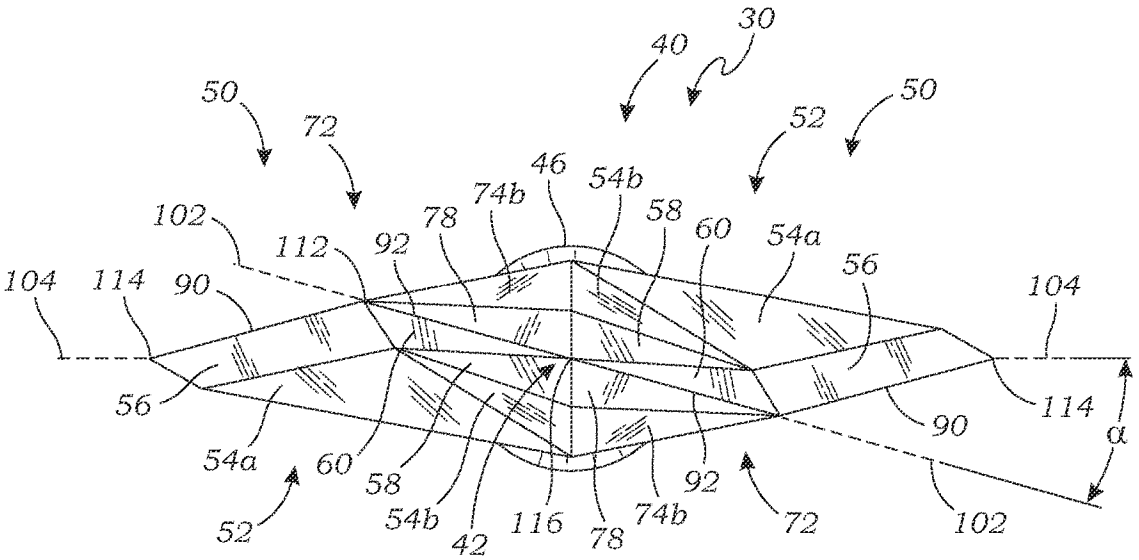
FIG. 12 is a front view thereof, in accordance with at least one embodiment.
Figure 13:
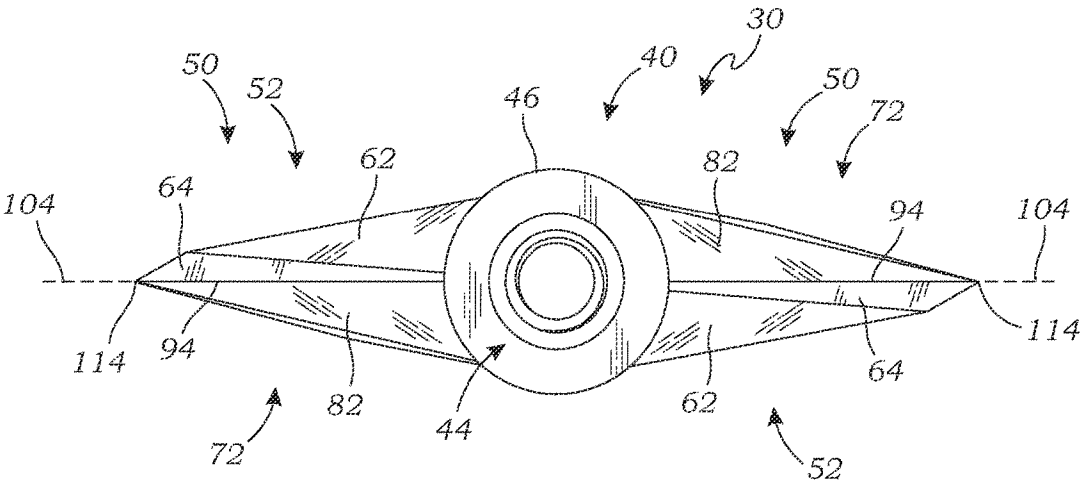
FIG. 13 is a rear view thereof, in accordance with at least one embodiment.
Figure 14:
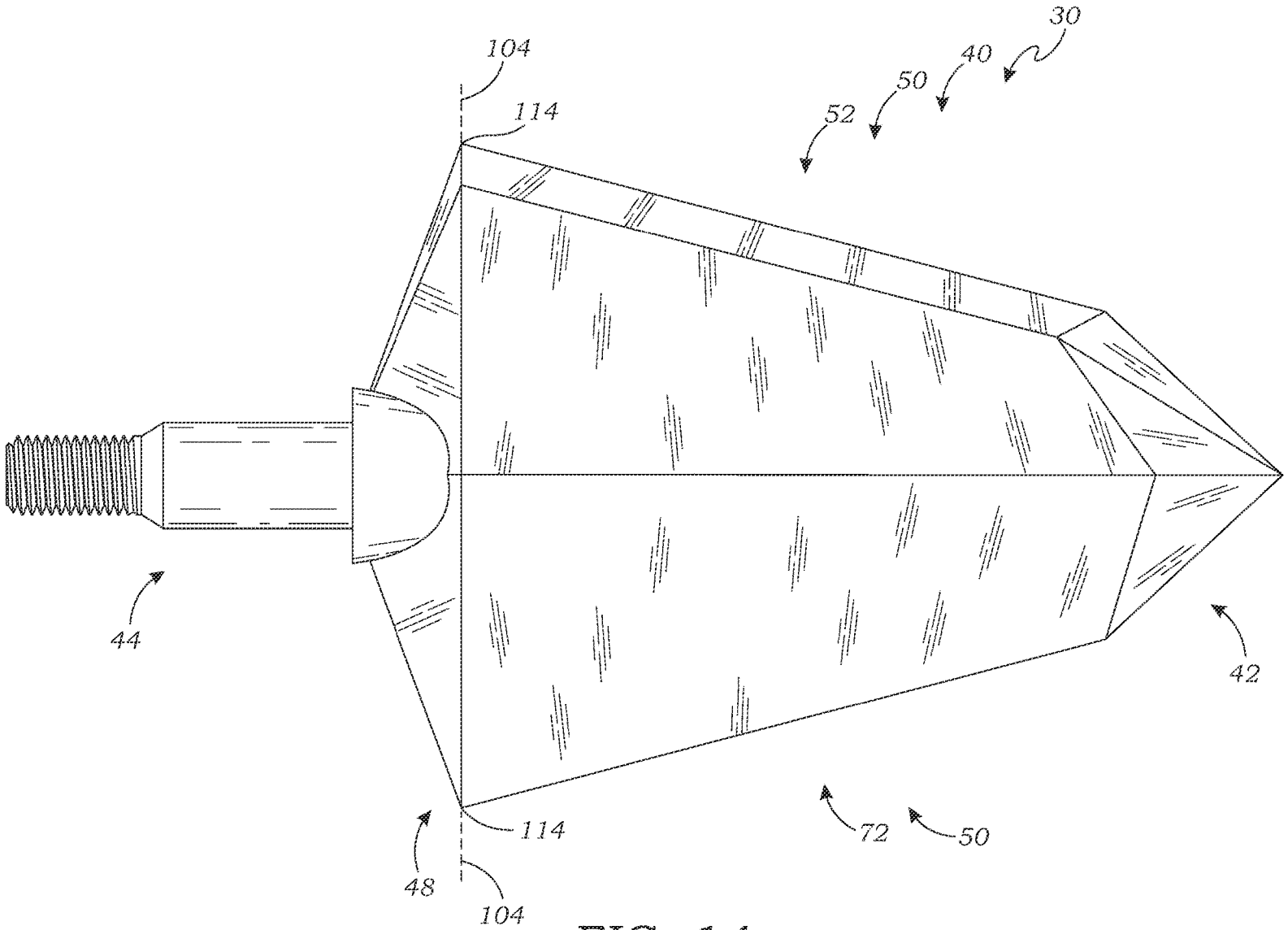
FIG. 14 is a top view of a further alternative exemplary broadhead, in accordance with at least one embodiment.
Figure 15:
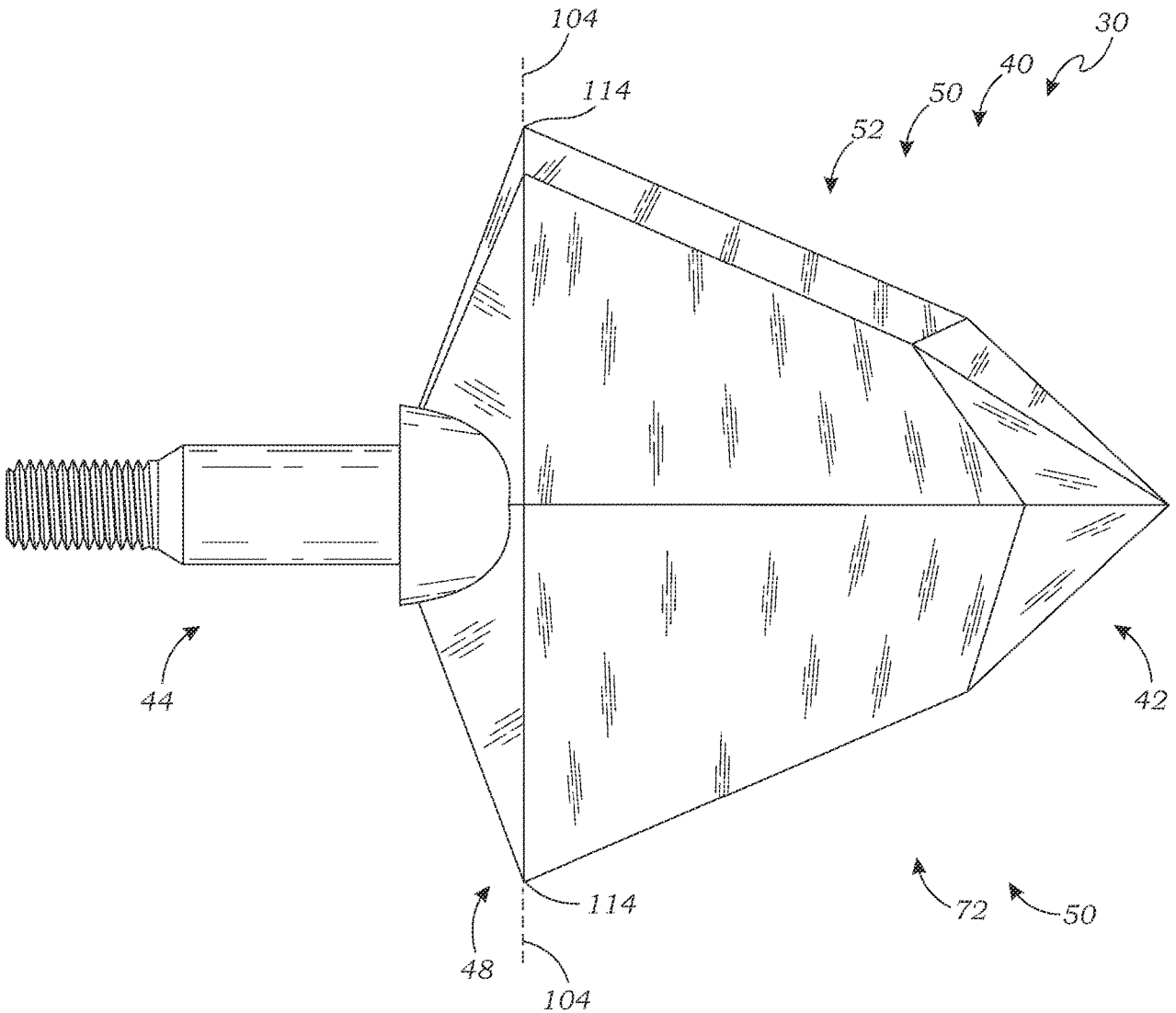
FIG. 15 is a top view of a still further alternative exemplary broadhead, in accordance with at least one embodiment.
Figure 16:
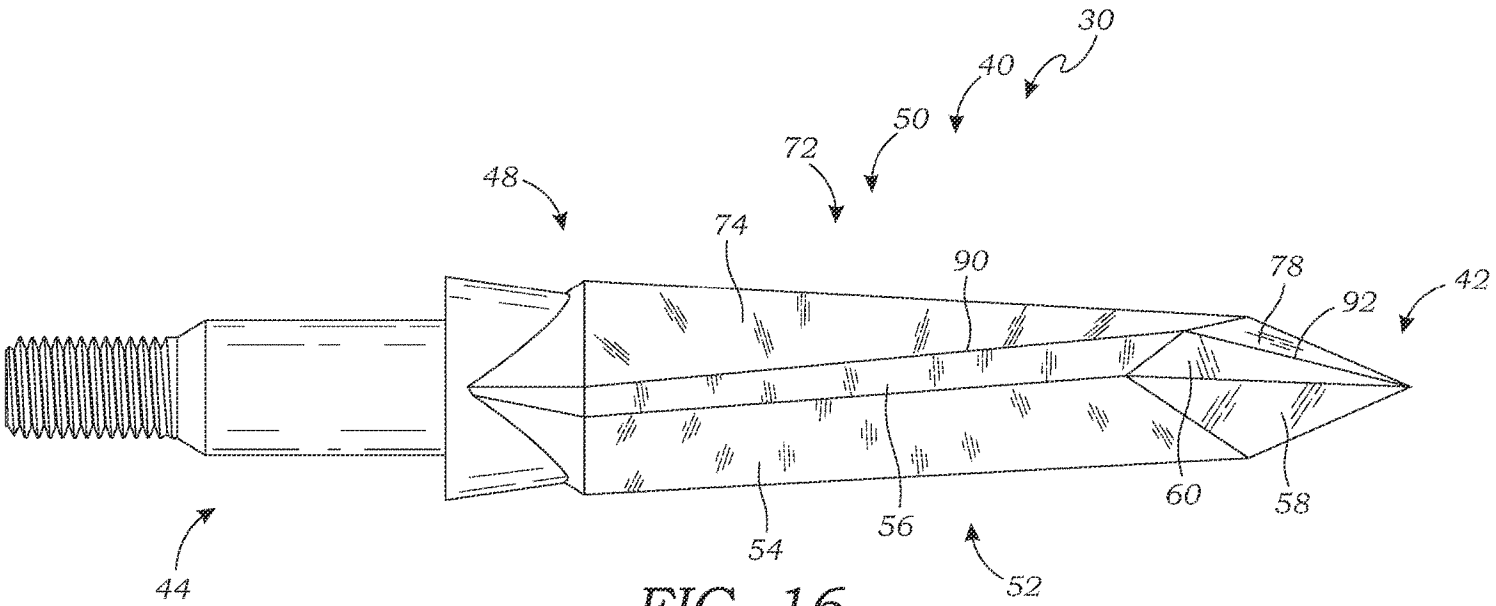
FIG. 16 is a side view of a still further alternative exemplary broadhead, in accordance with at least one embodiment.
Figure 17:
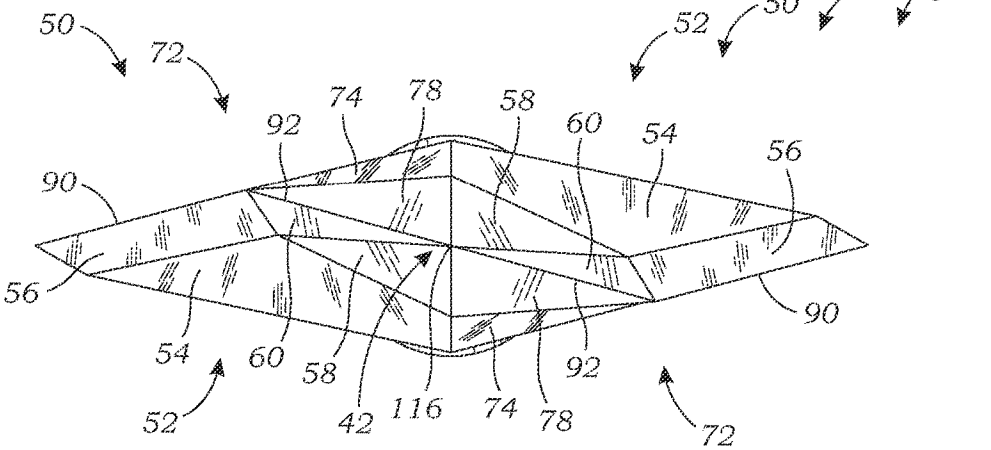
FIG. 17 is a front view thereof, in accordance with at least one embodiment.
Figure 18:
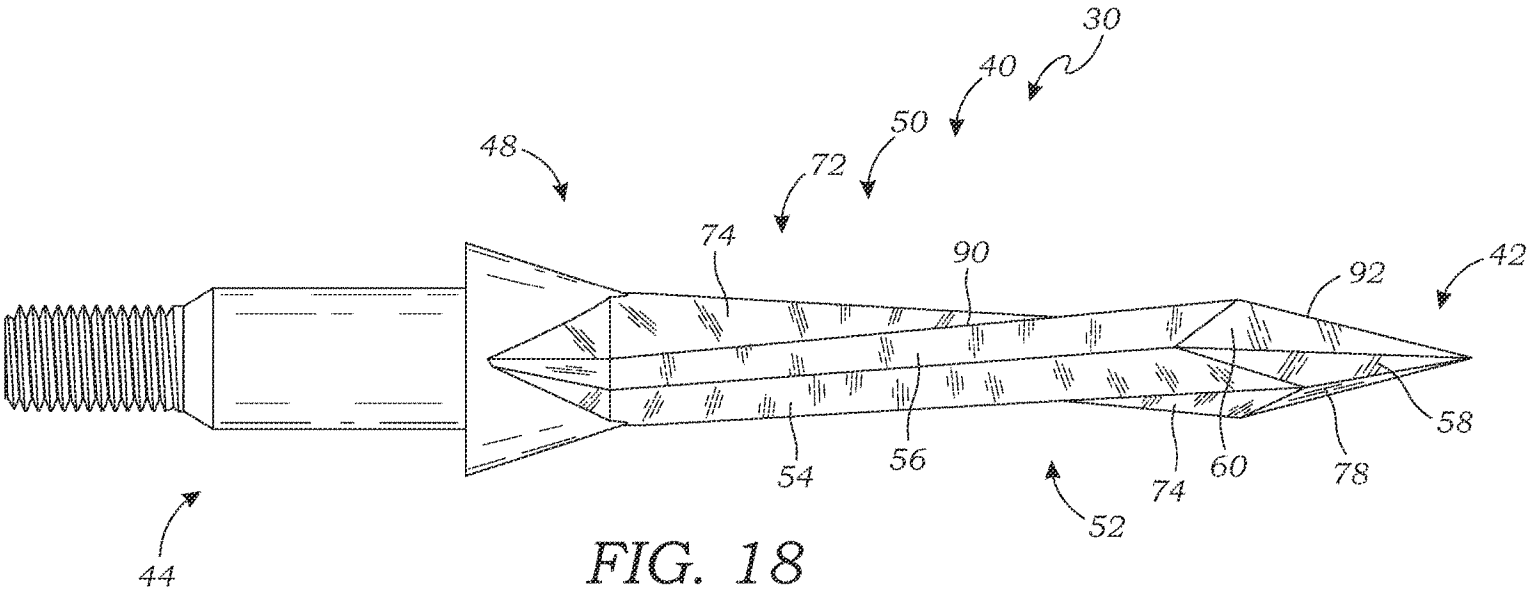
FIG. 18 is a side view of a still further alternative exemplary broadhead, in accordance with at least one embodiment.
Figure 19:
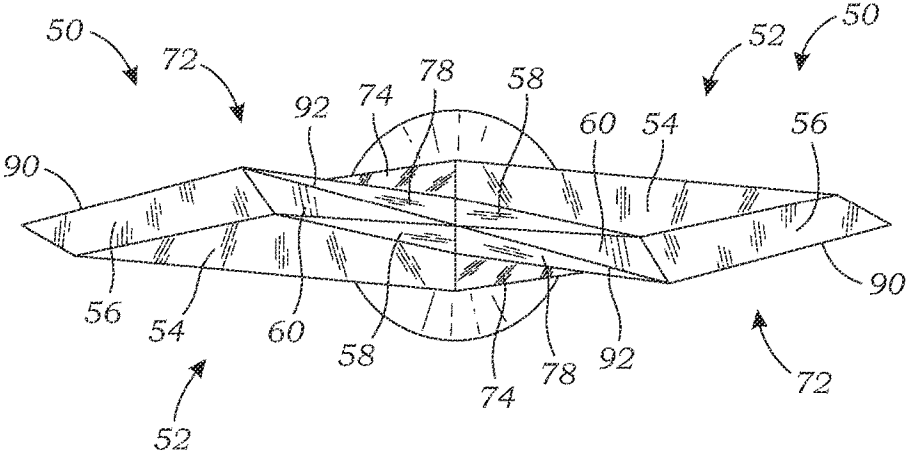
FIG. 19 is a front view thereof, in accordance with at least one embodiment.
Figure 20:
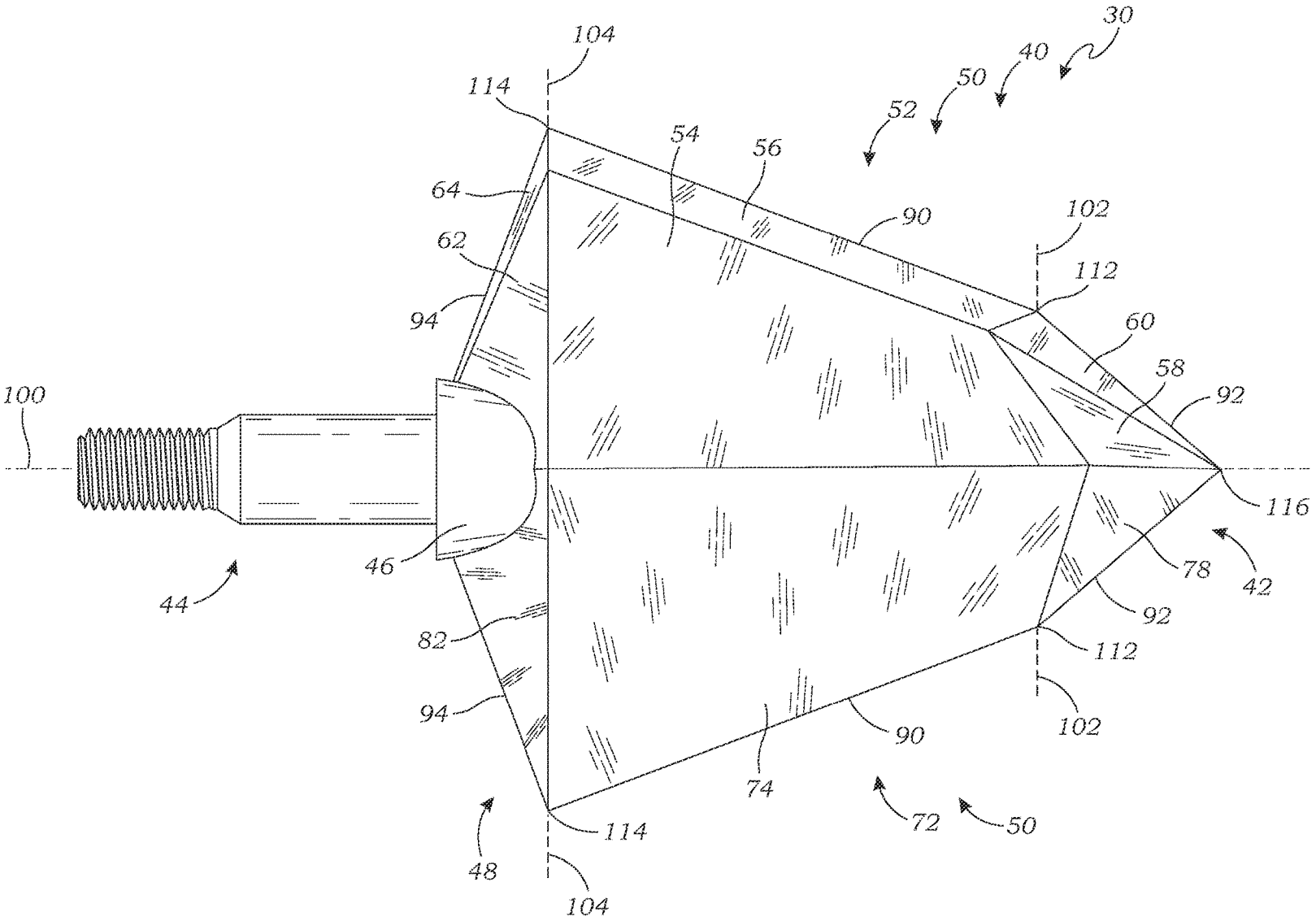
FIG. 20 is a top view of a still further alternative exemplary broadhead, in accordance with at least one embodiment.
Figure 21:
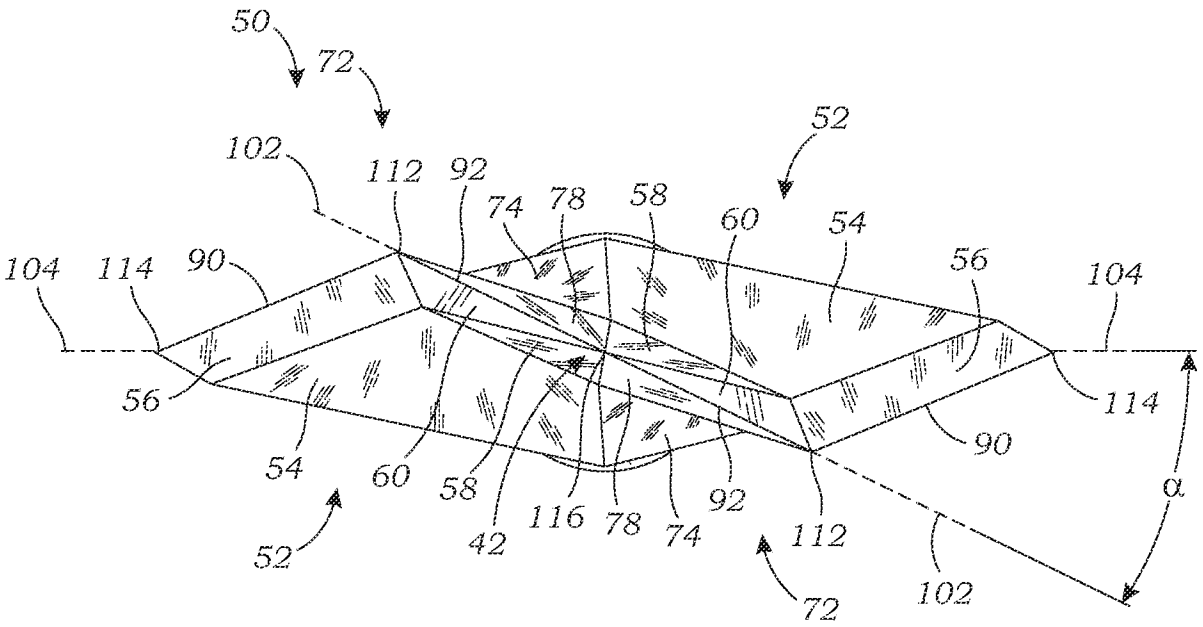
FIG. 21 is a front view thereof, in accordance with at least one embodiment.

With continued reference to FIGS. 2-7, the lateral and leading edges 90, 92 of each blade 50 are shown as being substantially straight, which it will be appreciated facilitates formation and maintenance of the first major surface and tip surface bevels 56, 60 for sustained performance of the broadhead 30 as by having sharp cutting edges 90, 92 terminating at the second major and tip surfaces 74, 78, respectively, more about which is said below. The lateral edge 90 of each blade 50 being essentially a line segment thus terminates in opposite end points, or distally in a distal point 112 and proximally in a proximal point 114, the distal point 112 thus marking the intersection of the lateral edge 90 and the leading edge 92 of each blade 50 and the proximal point 114 thus marking the intersection of the lateral edge 90 and the trailing edge 94 of each blade 50 in the exemplary embodiment. Notably, with particular reference to FIG. 4, a distal transverse axis 102 of each blade 50 is defined as a straight line perpendicular to the longitudinal axis 100 of the broadhead body 40 through a respective distal point 112, and a proximal transverse axis 104 of each blade 50 is defined as a straight line perpendicular to the longitudinal axis 100 through a respective proximal point 114, on which basis the distal and proximal transverse axes 102, 104 are parallel to each other or are in parallel planes as viewed from the top or the overall profile of the broadhead 30 as in FIG. 4. In the exemplary embodiments, the distal and proximal transverse axes 102, 104 pass entirely through each respective blade 50, meaning that each such axis 102, 104 defines a transverse or widthwise midline of the blade 50 structure distally and proximally. For the exemplary broadhead 30 having two opposed blades 50, it will be appreciated that the distal and proximal transverse axes 102, 104 of the blades 50 are coaxial and thus that effectively a single distal transverse axis 102 and a single proximal transverse axis 104 are defined for the two-bladed broadhead body 40. Critically, and regardless of the number of blades 50, as shown in FIG. 6, for each blade 50 the distal transverse axis 102 is at an angle α to the proximal transverse axis 104 such that the first major surface 54 of each blade 50 tapers or slopes or is tilted distally and both the first major surfaces 54 and the lateral edges 90 of the plurality of blades 50 are diverging, in the case of the lateral edges 90 meaning that lines drawn through such edges 90 would never cross, intersect, or converge. And since each leading edge 92 intersects the respective lateral edge 90 at an angle and further intersects the distal tip 42 or more specifically the tip point 116, so as to effectively reconnect the divergent lateral cutting edges 90 back to the central longitudinal axis 100 at the distal tip 42 of the construction along a continuous cutting edge made up of the leading edge 92 and the lateral edge 90, it follows that the first and second tip surfaces 58, 78 and the leading edges 92 of the plurality of blades 50 are converging. The resulting structure of the broadhead 30 as will be particularly appreciated from FIG. 6 is such that the distal tip 42 is effectively twisted or out of phase relative to the proximal end 48 of the broadhead body 40, as again represented by the distal transverse axis 102 that defines the widthwise midline of the distal tip 42 being rotated or at an angle α relative to the proximal transverse axis 104 defining the widthwise midline of the proximal end or base 48 of the body 40 and specifically the blades 50 that is shown as being horizontal as viewed from or looking at the distal tip 42 down the longitudinal axis 100 as in FIG. 6, which results in the related first major surfaces 54 of the opposite blades 50 being sloped or tilted oppositely, or from the vantage point shown the blade 50 on the right having its first major surface 54 angled downwardly and the 20) blade 50 on the left having its first major surface 54 angled upwardly. Those skilled in the art will appreciate that in flight such a broadhead 30 as illustrated would tend to rotate clockwise when viewed head on as shown or counterclockwise when viewed from the proximal end 48 or looking from the proximal shank 44 or end 48 down the longitudinal axis 100 toward the distal tip 42 in the direction of travel, as is commonly referred to in the art as a "left hand" broadhead or rotation, with air moving over the broadhead 30 from the distal tip 42 toward the proximal end 48 traveling along and pushing down on the sloped first major surface 54 of the blade 50 on the right and traveling along and pushing up on the sloped first major surface 54 of the blade 50 on the left. And as is known, rotation of an arrow A (FIG. 1) and any arrowhead or a broadhead 30 such as shown installed thereon has the benefit of truer or straighter flight ("rifling" aerodynamic effect) and relatively deeper penetration of a target, in the exemplary embodiment the direction of rotation causing any such penetration by the broadhead 30 to lead with the leading edges 92 and then the lateral cutting edges 90 of the blades 50, both such edges 90, 92 as again sharpened by the respective first major surface and tip bevels 54, 58 meeting the respective second major and tip surfaces 74, 78. As is also known, any fletching F on the proximal end of the arrow A itself opposite the broadhead 30 can be similarly configured to cause or cooperate with the direction of rotation in flight. For the particular exemplary broadhead 30 of FIGS. 1-7, the angle α of rotation or offset of the distal transverse axis 102 relative to the proximal transverse axis 104 of each blade 50 is approximately fifteen degrees (15°), though it will be appreciated by those skilled in the art that a variety of other angles or offsets are possible according to aspects of the present invention without departing from its spirit and scope, as will be further appreciated with reference to the alternative embodiments shown and described herein below.

Turning to FIGS. 8-13, there are shown perspective and orthographic views of an alternative exemplary embodiment of a broadhead 30 according to aspects of the present invention as again comprising a body 40 having a distal tip 42 and an opposite proximal shank 44 and a plurality of blades 50, or here once more two opposed blades 50 specifically. Such alternative exemplary embodiment is in fact quite analogous to that of FIGS. 1-7, including the twist at the distal tip 42 again being an angle α of approximately fifteen degrees (15°), with a primary distinction being that the sloped or titled first major surface 54 on the first side 52 of each blade 50 is not contoured or blended as it slopes from the proximal end 48 and from the center of the broadhead body 40 and so even is somewhat twisted to meet 20) the twisted distal tip 42 or particularly the converging first tip surface 58, and to a lesser extent even the second major surface 74, instead each such major surface 54, 74 is here shown as being faceted or having a distinct transition from a primary portion 54*a*, 74*a* of the respective major surface 54, 74, which proximally meets the respective proximal trailing surface 62, 82, to an angled portion 54*b*, 74*b* of the respective major surface 54, 74 running along or from the spine of the broadhead body 40 or the longitudinal axis 100 marking not just the centerline of the body 40 but the plane between the two blades 50, which distally meets the respective distal tip surface 58, 78. Those skilled in the art will appreciate that generally the more extreme the twist of the distal tip 42, or the greater the rotation or offset angle α of the distal transverse axis 102 relative to the proximal transverse axis 104, the greater the angle of inclination between the angled portions 54*b*, 74*b* of the respective major surfaces 54, 74 and the primary portions 54*a*, 74*a* of the respective major surfaces 54, 74 of the blades 50, which primary and angled portions 54*a*, 54*b* of the first side 52 of each blade 50 and/or primary and angled portions 74*a*, 74*b* of the second side 72 of each blade 50 may again remain faceted or relatively distinct as shown in the alternative embodiment of FIGS. 8-13 or may be relatively contoured or blended, whether in whole or in part, as in the exemplary embodiment of FIGS. 1-7 as well as the further alternative exemplary embodiments of FIGS. 14-26. Either way, the effect is particularly a sloping or tilted first major surface 54 of each blade 50 to induce rotation of the broadhead 30 during flight as herein described. And as will be appreciated from the discussion further below regarding formation of such a broadhead 30, any contouring or blending of such surface portions 54*a*, 54*b*, 74*a*, 74*b* of any blade 50 of a broadhead 30 according to aspects of the present invention may be accomplished in any appropriate manner now known or later developed, and again to whatever extent is desired. Regardless, it is to be understood that the first and second major surfaces 54, 74 and any portions 54*a*, 54*b*, 74*a*, 74*b* thereof are substantially planar in whole or pertinent part, versus being curved, helical, spiral, or some other configuration known in the art in an attempt to induce rotation. More generally, it will be appreciated once more that while particular broadhead designs are shown and described herein as having certain overall configurations and proportionality, the invention is not so limited, let alone any particular sizes or weights of such a broadhead 30 according to aspects of the present invention, which may vary widely depending on a number of factors related to construction and use.

Figure 22:
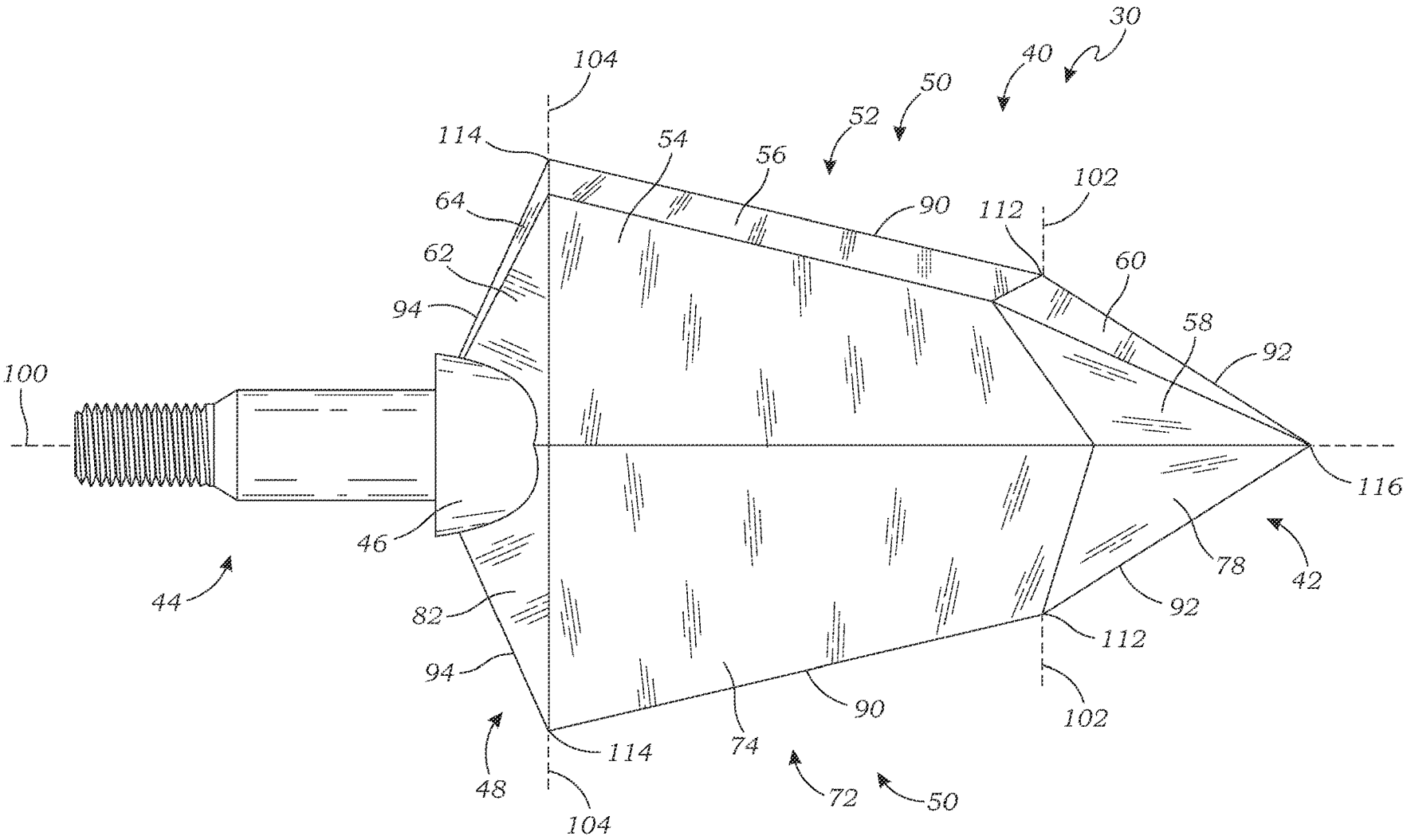
FIG. 22 is a top view of a still further alternative exemplary broadhead, in accordance with at least one embodiment.
Figure 23:
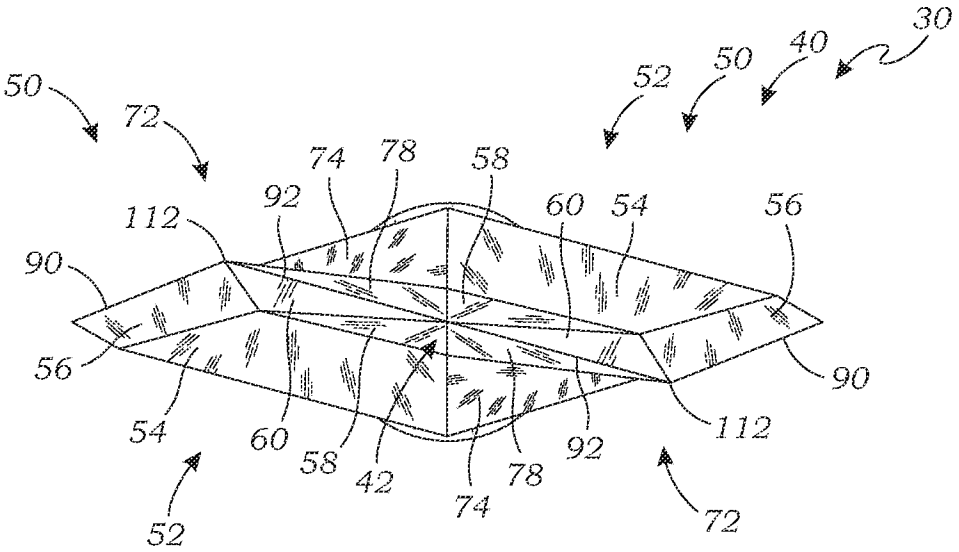
FIG. 23 is a front view thereof, in accordance with at least one embodiment.
Figure 24:
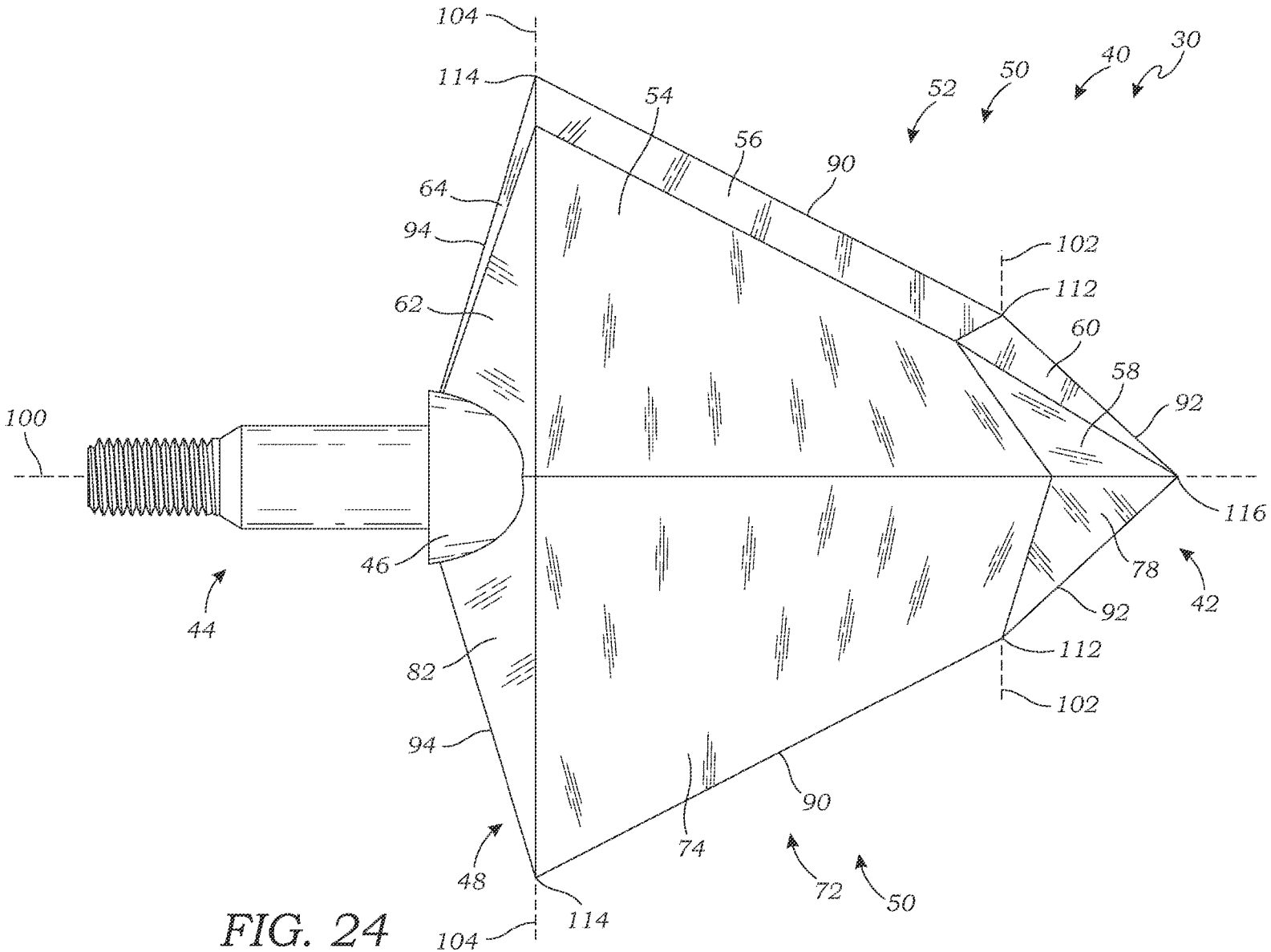
FIG. 24 is a top view of a still further alternative exemplary broadhead, in accordance with at least one embodiment.
Figure 25:
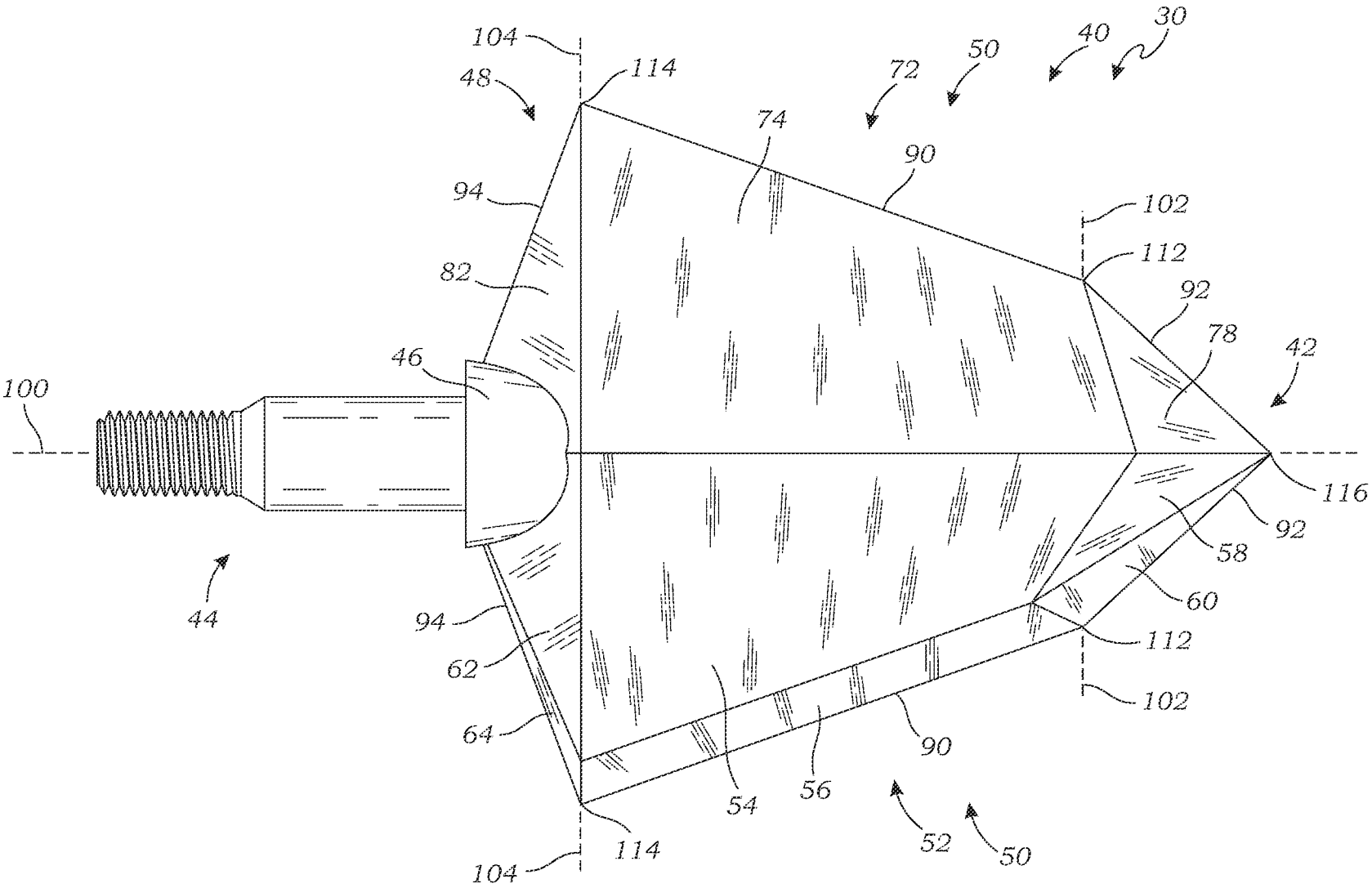
FIG. 25 is a top view of a still further alternative exemplary broadhead, in accordance with at least one embodiment.
Figure 26:
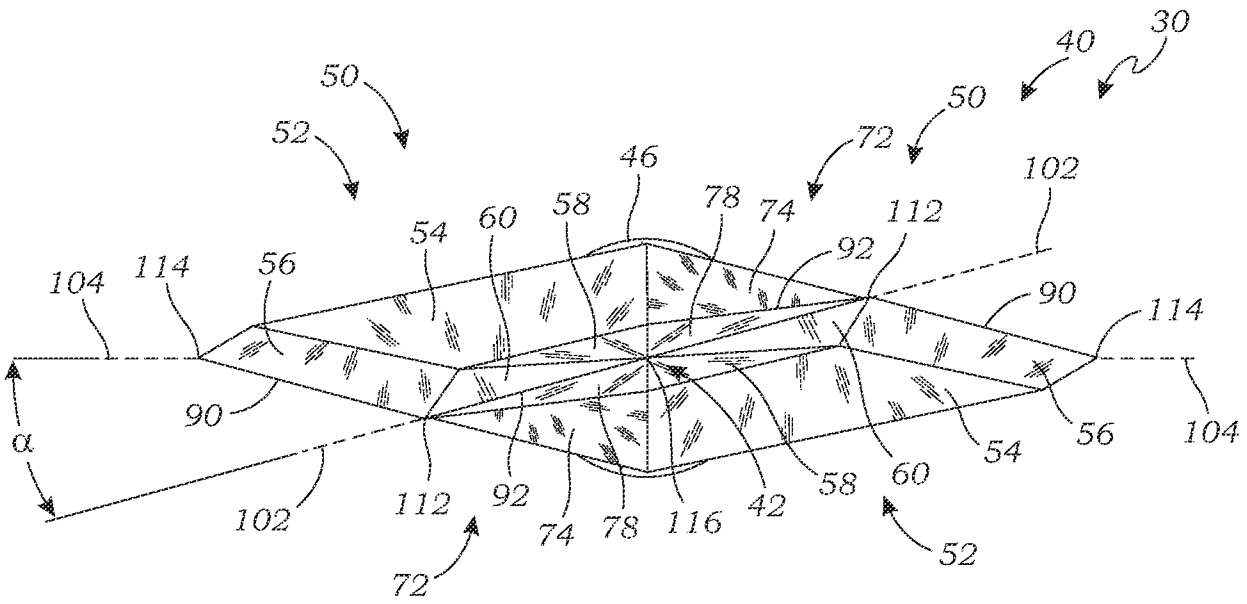
FIG. 26 is a front view thereof, in accordance with at least one embodiment.

Referring next to FIGS. 14-26, there are illustrated a variety of other alternative configurations of a broadhead 30 according to aspects of the present invention. In the top views of FIGS. 14-15 such a broadhead 30 is shown as proportionally either lengthened or shortened while, for example, keeping the same overall width of the broadhead 30, which in the exemplary two-bladed broadhead 30 is essentially the distance along the proximal transverse axis 104 between opposite proximal points 114. In the side and front views of FIGS. 16-17 and 18-19 there are shown versions of such a broadhead 30 as being relatively thicker or thinner or heavier or lighter, it being appreciated that the relatively thicker broadhead 30 would not only be heavier or have more weight but would allow for an even greater bevel angle of the first major surface and tip surface bevels 56, 60, the typical broadhead bevel being on the order of twenty to twenty-five degrees (20-25°) while the cutting edge bevels 56, 60 on the first side 52 of a broadhead blade 50 according to aspects of the present invention may be thirty degrees (30°) or more, and/or yield a stronger or more durable cutting edge 90, 92. Whereas even with the relatively thinner or lighter broadhead 30 shown in FIGS. 18-19, with the weight removed primarily from the proximal end 48 of the broadhead body 40 or in the vicinity of the first and second major surfaces 54, 74, the geometry at the distal tip 42 may remain comparable to thicker or heavier versions of an otherwise similar broadhead 30, thereby still allowing for the desired angle of the bevel 56, 60 and/or strength or durability of the cutting edge 90, 92. In the top and front views of FIGS. 20-21 there are shown a still further alternative exemplary embodiment of a broadhead 30 according to aspects of the present invention here having a more extreme twist at the distal tip 42 or essentially a relatively greater rotational or angular offset of the distal transverse axis 102 relative to the proximal transverse axis 104, here such angle $\alpha$ being approximately twenty-five degrees (25°), though again those skilled in the art will appreciate that a variety of angular offsets or degrees of twist at the distal tip 42 are possible according to aspects of the present invention without departing from its spirit and scope, including angles even greater than twenty-five degrees (25°) or less than the exemplary fifteen degrees (15°), or of course anywhere between fifteen and twenty-five degrees (15-25°), which range or more broadly between ten and thirty degrees (10-30°) would be preferable in or sufficient for most broadhead applications or anticipated uses, though distal tip 42 twist of up to even forty-five degrees (45°) is possible. The distance between the distal tip point 116 and the distal transverse axis 102 can be lengthened or shortened and the resulting geometry of the distal tip 42 may be flattened or even inverted below the distal transverse axis 102, in whole or in part, without departing from the spirit and scope of the present invention. In FIGS. 22-23, there are shown top and front views of a still further alternative exemplary embodiment of a broadhead 30 having a longer or pointier distal tip 42 as by effectively lengthening that region or flattening and/or widening the distal tip 42 at its base as denoted by the length of the distal transverse axis 102 between opposite distal points 112, such that the distal tip 42 is proportionally a greater percentage of the overall length of the broadhead body 40. In FIG. 24 there is shown a top view of a further alternative exemplary embodiment in which the overall width of the broadhead 30 is increased relative to the overall length, as by having an increased length of the proximal transverse axis 104 between opposite proximal points 114 without increasing the length of the broadhead body 40, which change in proportionality again is merely illustrative and may be suited to a particular application or use. And finally, referring to the top and front views of FIGS. 25-26, there is shown a still further alternative exemplary embodiment of a broadhead 30 according to aspects of the present invention analogous to the exemplary embodiment of FIGS. 1-7 except that here the broadhead 30 is formed in a "right hand" configuration, meaning that in flight such an alternative broadhead 30 as illustrated would tend to rotate counterclockwise when viewed head on as shown in FIG. 26 or clockwise when viewed from the proximal end 48 or looking from the proximal shank 44 or end 48 down the longitudinal axis 100 toward the distal tip 42 in the direction of travel, with air moving over the broadhead 30 from the distal tip 42 toward the proximal end 48 traveling along and pushing down on the sloped first major surface 54 of the blade 50 on the left and traveling along and pushing up on the sloped first major surface 54 of the blade 50 on the right. Once more, such a "right hand" broadhead 30 as in FIGS. 25-26 may take any configuration or proportionality beyond what is shown without departing from the spirit and scope of the invention, such that the version depicted and again all other exemplary embodiments shown and described herein are to be understood as merely illustrative and non-limiting.

In forming the broadhead 30, including the body 40 and the two or more blades 50, it will be appreciated that any appropriate materials and methods of construction now known or later developed may be employed, including but not limited to metals such as steel, aluminum, alloys, and the like and a variety of plastics such as polypropylene, polyvinyl chloride ("PVC"), acrylonitrile butadiene styrene ("ABS"), polyethylenes such as high density polyethylene ("HDPE"), polycarbonate, and other such plastics, thermoplastics, thermosetting polymers, resins, and the like, any such components being fabricated as through machining, stamping, forming, additive manufacturing such as 3D printing, casting, injection molding, extrusion, or any other such technique or combination thereof now known or later developed. Relatedly, such components may be formed integrally or may be formed separately and then assembled in any appropriate secondary operation employing any assembly technique now known or later developed, including but not limited to fastening, bonding, welding, over-molding or coining, press-fitting, snapping, or any other such technique or combination thereof, and whether permanently or able to be disassembled and reassembled. Those skilled in the art will fundamentally appreciate that any such materials and methods of construction are encompassed within the scope of the invention, any exemplary materials and methods in connection with any and all embodiments thus being illustrative and non-limiting. Surfaces or edges of the broadhead body 40 may be smoothed, roughened, contoured, sharpened, or otherwise formed in the final configuration of the broadhead 30 for use as desired or appropriate for a particular context, and that again by or as part of the original production step or in a secondary operation, whether now known or later developed. By way of illustration and not limitation, a serrated diamond pattern may be formed on the major and/or tip blade surfaces 54, 58, 74, 78 to further increase penetration and lethality when a target is struck. Dimensionally, the overall size and scale or proportionality of any such broadhead 30 according to aspects of the present invention may again vary widely based on a number of factors and contexts—in the present exemplary embodiments, the overall length of the broadhead body 40 from the distal tip 42 to the proximal shank 44 may range from roughly one-and-a-half to four inches (1.5-4 in.), or of the body 40 from the distal tip 42 to the proximal end 48, or thus the length of the blades 50 themselves without the proximal shank 44, may be roughly one to three inches (1-3 in.), and the overall width of the broadhead body 40 as being the maximum transverse dimension at the proximal end or base 48 of the body 40 (again, in the scenario where two opposing blades 50 are one-hundred eighty degrees (180°) apart such that their proximal transverse axes 104 are colinear) may be roughly three-quarter inch to three inches (0.75-3 in.), though again other sizes and shapes or configurations are possible according to aspects of the present invention. For the exemplary proximal shank 44 itself, for the purpose of installing in conventional arrow shafts S, such may be a nominally four millimeter (4 mm) diameter shaft with an 8-32 male thread for threadably engaging the receiver R with matching female thread on the distal end of an arrow shaft S, though it will again be appreciated that a variety of configurations and sizes of such proximal shank 44 may be employed as appropriate to suit any related arrow shaft R, whether now known or later developed, such that the exemplary threaded engagement is to be understood as illustrative and non-limiting. By way of further illustration and not limitation, a broadhead 30 according to aspects of the present invention can be designed or configured for industry standard attachment to arrows intended for use with traditional bows, compound bows, or crossbows wherein there is a proximal threaded shank in-line with the central longitudinal axis or a proximal void in-line with the central longitudinal axis intended for over arrow shaft application or attachment to an arrow or crossbow bolt. In addition to the overall size in terms of length and width of any such broadhead 30, such may also be expressed as a weight, for example, in the range of two tenths to three tenths of an ounce (0.2-0.3 oz.) or more or roughly ninety to one hundred twenty-five grains (90-125 gr.), though again scalable from such typical sizes for relatively small game hunting to much larger broadheads for the largest thick-skinned game weighing over two ounces (2 oz.) or over one thousand grains (1,000 gr.). Other configurations of any such broadhead 30 and related considerations include the number of blades 50 and whether the blades 50 are non-vented or solid as in the exemplary embodiments or are vented as having holes or openings known as vents (not shown), which of course would affect the weight and other characteristics of the broadhead 30 though would not necessarily affect the "twist at the tip" aspects of broadhead designs according to aspects of the present invention, such that the exemplary two-bladed non-vented broadheads 30 are again to be understood as illustrative and non-limiting, even if such form may be the most common or preferable configuration of a broadhead 30 according to aspects of the present invention. Taking the exemplary embodiments, though, while not necessary, it is also preferable that any such broadhead 30 be formed integrally or of a unitary, solid construction.

In sum, aspects of the present invention relate to a broadhead or arrow tip construction having a plurality of blades with somewhat planar surfaces and lateral cutting edges positioned about a central longitudinal axis, the blades defining a proximal transverse axis and an offset distal transverse axis that each intersect and are perpendicular to the central longitudinal axis of the broadhead, with the primary blade surfaces offset by rotating the distal transverse axis relative to the proximal transverse axis so as to cause the blade surfaces and the lateral cutting edges to slope and diverge while maintaining straight cutting edges with leading cutting edges that connect the divergent lateral cutting edges to the central longitudinal axis at the distal tip of the construction. Again, the broadhead may have two or more blades, each blade having a first side with beveled edge that is relatively sloped or slanted and an opposite second side, and whether each blade is solid or vented and whether the broadhead and all such blades are integral or are removable. With two (or four) blades spaced equidistantly about the broadhead, each transverse axis is continuous or colinear, or there is a single or common axis through the distal and proximal regions of the broadhead body (or each pair of blades), while if there are three blades (or an odd number of blades) spaced equidistantly, each transverse axis would not be continuous or colinear, just coplanar, the key being that for each individual blade the distal transverse axis is rotated or out of phase with or at an angle to the proximal transverse axis so as to have a "twisted tip." Once more, any of the blade surfaces can be substantially planar with portions somewhat faceted or the transitions between portions of the surfaces defined or instead the blade surfaces can be contoured with the transitions between portions of the surfaces blended or smoothed. The features and relative proportionality of any such broadhead according to aspects of the present invention can be scaled up or down in practically limitless ways, including varying the blades within a single broadhead. Those skilled in the art will again appreciate that all such features and combinations thereof consistent with aspects of the present invention may be substituted or varied without departing from the spirit and scope of the invention, such that any exemplary embodiments and any characterizations thereof or related summary statements regarding all such embodiments are to be understood as illustrative and non-limiting.

Aspects of the present specification may also be described as follows:

1. A broadhead comprising a body having a plurality of blades defining a proximal end and an opposite distal tip, the body having a longitudinal axis therethrough, wherein each blade has a first side having a first major surface and an opposite second side having a second major surface terminating laterally in a straight lateral edge, wherein the lateral edge terminates distally at a distal point proximal of the distal tip and terminates proximally at a proximal point, a distal transverse axis of each blade being a straight line perpendicular to the longitudinal axis through each distal point, and a proximal transverse axis of each blade being a straight line perpendicular to the longitudinal axis through each proximal point, the distal and proximal transverse axes passing entirely through each respective blade, and wherein for each blade the distal transverse axis is at an angle to the proximal transverse axis such that the first major surface of each blade is sloped distally and the first major surfaces and the lateral edges of the plurality of blades are diverging, whereby the distal tip is twisted relative to the proximal end.

2. The broadhead of embodiment 1 wherein the first side further has a first tip surface distal of and at an angle to the first major surface and the second side further has a second tip surface distal of and at angle to the second major surface and terminating laterally in a straight leading edge intersecting the respective lateral edge, each distal point is at the intersection of the lateral edge and the leading edge of the respective blade, and each leading edge is at an angle to the respective lateral edge and further intersects a tip point of the distal tip such that the first and second tip surfaces and the leading edges of the plurality of blades are converging.

3. The broadhead of embodiment 1 or embodiment 2 wherein the first side further has a first trailing surface proximal of and at an angle to the first major surface and the second side further has a second trailing surface proximal of and at an angle to the second major surface and terminating proximally in a straight trailing edge intersecting the respective lateral edge, and each proximal point is at the intersection of the lateral edge and the trailing edge of the respective blade.

4. The broadhead of embodiment 2 or embodiment 3 wherein the first major surface is formed laterally with a first major surface bevel and the first tip surface is formed laterally with a first tip surface bevel, and for each blade of the broadhead the first major surface bevel meets the second major surface along the respective lateral edge and the first tip surface bevel meets the second tip surface along the respective leading edge.

5. The broadhead of embodiment 3 or embodiment 4 wherein the first trailing surface is formed proximally with a first trailing surface bevel, and for each blade of the broadhead the first trailing surface bevel meets the second trailing surface along the respective trailing edge.

6. The broadhead of any of embodiments 1-5 wherein the distal transverse axis defines a widthwise midline of the distal tip of each blade.

7. The broadhead of any of embodiments 1-6 wherein the proximal transverse axis defines a widthwise midline of the proximal end of each blade.

8. The broadhead of any of embodiments 1-7 wherein the angle between the distal transverse axis and the proximal transverse axis is in the range of ten to thirty degrees.

9. The broadhead of any of embodiments 1-8 wherein the angle between the distal transverse axis and the proximal transverse axis is fifteen degrees.

10. The broadhead of any of embodiments 1-9 wherein the first major surface of each blade is contoured, having a blended transition from a first major surface primary portion that proximally meets a first trailing surface of each blade to a first major surface angled portion extending along the first major surface primary portion and that distally meets a first tip surface of each blade.

11. The broadhead of any of embodiments 1-10 wherein the second major surface of each blade is contoured, having a blended transition from a second major surface primary portion that proximally meets a second trailing surface of each blade to a second major surface angled portion extending along the second major surface primary portion and that distally meets a second tip surface of each blade.

12. The broadhead of any of embodiments 1-9 and 11 wherein the first major surface of each blade is faceted, having a distinct transition from a first major surface primary portion that proximally meets a first trailing surface of each blade to a first major surface angled portion extending along the first major surface primary portion and that distally meets a first tip surface of each blade.

13. The broadhead of any of embodiments 1-10 and 12 wherein the second major surface of each blade is faceted, having a distinct transition from a second major surface primary portion that proximally meets a second trailing surface of each blade to a second major surface angled portion extending along the second major surface primary portion and that distally meets a second tip surface of each blade.

14. The broadhead of any of embodiments 1-13 further comprising a proximal shank extending proximally from the proximal end of the body along the longitudinal axis, the proximal shank configured for engagement with an arrow shaft.

15. The broadhead of embodiment 14 wherein the proximal shank is threaded and configured for threadable engagement with a receiver of the arrow shaft.

16. The broadhead of embodiment 14 or embodiment 15 wherein a ferrule is formed at the interface between the proximal shank and the proximal end of the body.

17. The broadhead of any of embodiments 1-16 wherein the plurality of blades consists of two opposed blades and the distal and proximal transverse axes of the blades are coaxial.

18. The broadhead of any of embodiments 1-17 wherein each of the plurality of blades is solid.

19. The broadhead of any of embodiments 1-18 wherein the body and the plurality of blades are integral.

In closing, regarding the exemplary embodiments of the present invention as shown and described herein, it will be appreciated that a broadhead is disclosed and configured for improved rotation and penetration. Because the principles of the invention may be practiced in a number of configurations beyond those shown and described, it is to be understood that the invention is not in any way limited by the exemplary embodiments but is generally directed to a new and improved broadhead and is able to take numerous forms without departing from the spirit and scope of the invention. It will also be appreciated by those skilled in the art that the present invention is not limited to the particular geometries and materials of construction disclosed but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

In some embodiments, the numbers expressing quantities of components or ingredients, properties such as dimensions, weight, concentration, reaction conditions, and so forth, used to describe and claim certain embodiments of the inventive subject matter are to be understood as being modified in some instances by terms such as "about," "approximately," or "roughly." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the inventive subject matter are approximations, the numerical values set forth in any specific examples are reported as precisely as practicable. The numerical values presented in some embodiments of the inventive subject matter may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. The recitation of numerical ranges of values herein is merely intended to serve as a shorthand method of referring individually to each separate value falling within the range. Unless otherwise indicated herein, each individual value of a numerical range is incorporated into the specification as if it were individually recited herein. Similarly, all lists of values should be considered as inclusive of intermediate values unless the context indicates the contrary.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the inventive subject matter and does not pose a limitation on the scope of the inventive subject matter otherwise claimed. No language in the application should be construed as indicating any non-claimed element essential to the practice of the invention.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A broadhead comprising:

a body having a plurality of blades defining a proximal end and an opposite distal tip, the body having a longitudinal axis therethrough;

wherein each blade has a first side having a first major surface and an opposite second side having a second major surface terminating laterally in a straight lateral edge;

wherein the lateral edge terminates distally at a distal point proximal of the distal tip and terminates proximally at a proximal point, a distal transverse axis of each blade being a straight line perpendicular to the longitudinal axis through each distal point, and a proximal transverse axis of each blade being a straight line perpendicular to the longitudinal axis through each proximal point, the distal and proximal transverse axes passing entirely through each respective blade; and wherein for each blade the distal transverse axis is at an angle to the proximal transverse axis such that the first major surface of each blade is sloped distally and the first major surfaces and the lateral edges of the plurality of blades are diverging, whereby the distal tip is twisted relative to the proximal end.

2. The broadhead of claim 1 wherein:

the first side further has a first tip surface distal of and at an angle to the first major surface and the second side further has a second tip surface distal of and at angle to the second major surface and terminating laterally in a straight leading edge intersecting the respective lateral edge;

each distal point is at the intersection of the lateral edge and the leading edge of the respective blade; and each leading edge is at an angle to the respective lateral edge and further intersects a tip point of the distal tip such that the first and second tip surfaces and the leading edges of the plurality of blades are converging.

3. The broadhead of claim 2 wherein:

the first side further has a first trailing surface proximal of and at an angle to the first major surface and the second side further has a second trailing surface proximal of and at an angle to the second major surface and terminating proximally in a straight trailing edge intersecting the respective lateral edge; and each proximal point is at the intersection of the lateral edge and the trailing edge of the respective blade.

4. The broadhead of claim 3 wherein:

the first major surface is formed laterally with a first major surface bevel and the first tip surface is formed laterally with a first tip surface bevel; and for each blade of the broadhead the first major surface bevel meets the second major surface along the respective lateral edge and the first tip surface bevel meets the second tip surface along the respective leading edge.

5. The broadhead of claim 4 wherein:

the first trailing surface is formed proximally with a first trailing surface bevel; and for each blade of the broadhead the first trailing surface bevel meets the second trailing surface along the respective trailing edge.

6. The broadhead of claim 1 wherein the distal transverse axis defines a widthwise midline of the distal tip of each blade.

7. The broadhead of claim 1 wherein the proximal transverse axis defines a widthwise midline of the proximal end of each blade.

8. The broadhead of claim 1 wherein the angle between the distal transverse axis and the proximal transverse axis is in the range of ten to thirty degrees.

9. The broadhead of claim 8 wherein the angle between the distal transverse axis and the proximal transverse axis is fifteen degrees.

10. The broadhead of claim 1 wherein the first major surface of each blade is contoured, having a blended transition from a first major surface primary portion that proximally meets a first trailing surface of each blade to a first major surface angled portion extending along the first major surface primary portion and that distally meets a first tip surface of each blade.

11. The broadhead of claim 10 wherein the second major surface of each blade is contoured, having a blended transition from a second major surface primary portion that proximally meets a second trailing surface of each blade to a second major surface angled portion extending along the second major surface primary portion and that distally meets a second tip surface of each blade.

12. The broadhead of claim 1 wherein the first major surface of each blade is faceted, having a distinct transition from a first major surface primary portion that proximally meets a first trailing surface of each blade to a first major surface angled portion extending along the first major surface primary portion and that distally meets a first tip surface of each blade.

13. The broadhead of claim 12 wherein the second major surface of each blade is faceted, having a distinct transition from a second major surface primary portion that proximally meets a second trailing surface of each blade to a second major surface angled portion extending along the second major surface primary portion and that distally meets a second tip surface of each blade.

14. The broadhead of claim 1 further comprising a proximal shank extending proximally from the proximal end of the body along the longitudinal axis, the proximal shank configured for engagement with an arrow shaft.

15. The broadhead of claim 14 wherein the proximal shank is threaded and configured for threadable engagement with a receiver of the arrow shaft.

16. The broadhead of claim 14 wherein a ferrule is formed at the interface between the proximal shank and the proximal end of the body.

17. The broadhead of claim 1 wherein the plurality of blades consists of two opposed blades and the distal and proximal transverse axes of the blades are coaxial.

18. The broadhead of claim 1 wherein each of the plurality of blades is solid.

19. The broadhead of claim 1 wherein the body and the plurality of blades are integral.

20. A broadhead comprising:

a body having two opposed blades defining a proximal end and an opposite distal tip, the body having a longitudinal axis therethrough;

wherein each blade has a first side having a first major surface formed outwardly with a first major surface bevel, the first side further having a first tip surface distal of the first major surface and formed outwardly with a first tip surface bevel, and the first side further having a first trailing surface proximal of the first major surface and formed outwardly with a first trailing surface bevel;

wherein each blade has a second side opposite the first side, the second side having a second major surface, a second tip surface distal of the second major surface, and a second trailing surface proximal of the second major surface;

wherein for each blade the first major surface bevel meets the second major surface along a straight lateral edge, the first tip surface bevel meets the second tip surface along a straight leading edge, and the first trailing surface bevel meets the second trailing surface along a straight trailing edge;

wherein for each blade the lateral edge connects to the leading edge at a distal point and the lateral edge connects to the trailing edge at a proximal point, a distal transverse axis of each blade being a straight line perpendicular to the longitudinal axis through each distal point, and a proximal transverse axis of each blade being a straight line perpendicular to the longitudinal axis through each proximal point, the distal and proximal transverse axes of the blades being coaxial; and wherein for each blade the distal transverse axis is at an angle to the proximal transverse axis such that the first major surface of each blade is sloped distally and the first major surfaces and the lateral edges of the blades are diverging and further wherein each leading edge is at an angle to the respective lateral edge and further intersects a tip point of the distal tip such that the first and second tip surfaces and the leading edges of the blades are converging, whereby the distal tip is twisted relative to the proximal end.

* * * * *